US012691485B2

(12) United States Patent
Sizemore

(10) Patent No.: US 12,691,485 B2
(45) Date of Patent: Jul. 28, 2026

(54) MULTI-SPEED LIGHTWEIGHT GUTTER MACHINE

(71) Applicant: SPARTAN MACHINE LLC, Lebanon, OH (US)

(72) Inventor: David Scott Sizemore, Hamilton, OH (US)

(73) Assignee: SPARTAN MACHINE LLC, Lebanon, OH (US)

( * ) Notice: Subject to any disclaimer, the term of this patent is extended or adjusted under 35 U.S.C. 154(b) by 416 days.

(21) Appl. No.: 18/244,006

(22) Filed: Sep. 8, 2023

(65) Prior Publication Data

US 2025/0083208 A1 Mar. 13, 2025

(51) Int. Cl.

| | |
|---|---|
| ***B21D 5/08*** | (2006.01) |
| ***B21B 39/12*** | (2006.01) |
| ***B21D 13/04*** | (2006.01) |

(52) U.S. Cl.

CPC ..... *B21D 5/08* (2013.01); *B21B 39/12* (2013.01); *B21D 13/04* (2013.01)

(58) Field of Classification Search

CPC ..... B21D 5/08; B21D 13/04; B21B 39/12
See application file for complete search history.

(56) References Cited

U.S. PATENT DOCUMENTS

| | | | | |
|---|---|---|---|---|
| 117,255 A * | 7/1871 | Buffum | ..... | B27C 5/10 144/134.1 |
| 2,826,235 A * | 3/1958 | Gudmestad | ..... | B21D 5/08 72/181 |
| 3,791,185 A * | 2/1974 | Knudson | ..... | B21D 5/08 72/181 |
| 3,874,214 A * | 4/1975 | Racicot | ..... | B21D 13/02 72/385 |

(Continued)

OTHER PUBLICATIONS

KWM Gutterman, "Iron Man Seamless Rollformers Operating and Maintenance Troubleshooting Guide", obtained from URL https://www.lynchaluminum.com/wp-content/uploads/2018/03/Ironman-Manual-Encompasses-all-Ironman-Machines.pdf on Sep. 8, 2023.

(Continued)

*Primary Examiner* — Ryan J. Walters
(74) *Attorney, Agent, or Firm* — Basil M. Angelo; ANGELO IP

(57) ABSTRACT

A multi-speed lightweight gutter machine includes a lightweight aluminum frame having hollow structural members. Each forming stage includes structural support members, flintstone transfer rollers, and at least some forming stages have forming wheels composed of lightweight plastic to further reduce the weight of the machine. The machine includes an inverter unit that converts single-phase power into three-phase power, a three-phase electric motor, and a variable frequency drive unit that controls the speed of the motor by controlling the frequency of the three-phase power applied to the motor. A controller unit commands the vari- (Continued)

able frequency drive unit to a user-selected speed. Wiring for electrical components is primarily routed within the interior of the hollow structural members of the lightweight aluminum frame to enhance safety. A transparent protective cover protects the interior of the machine while providing visibility to the operator.

16 Claims, 22 Drawing Sheets

(56) References Cited

U.S. PATENT DOCUMENTS 4,138,875 A * 2/1979 Hooper ..... B21D 13/02 72/312
4,660,399 A * 4/1987 Suter ..... B21D 5/08 72/181
4,787,233 A * 11/1988 Beymer ..... B21D 5/08 72/181
4,899,566 A * 2/1990 Knudson ..... B21D 5/08 72/247
5,148,694 A * 9/1992 Pearson ..... B21D 5/08 72/181
5,315,853 A * 5/1994 Scheiterle ..... B21D 5/08 242/598.3
5,425,259 A * 6/1995 Coben ..... B21D 5/08 72/181
5,551,272 A * 9/1996 Knudson ..... B21D 5/08 72/181
5,664,451 A * 9/1997 Schultz ..... B21D 13/045 72/379.6
5,740,687 A * 4/1998 Meyer ..... B23D 35/001 72/181
5,791,222 A * 8/1998 Micouleau ..... E04D 13/064 269/235
6,282,935 B1 * 9/2001 Bowers ..... B23D 23/00 72/181
6,438,819 B1 * 8/2002 McGlinchy ..... B21D 5/086 72/181
6,439,020 B1 * 8/2002 Baschnagel, III ..... B21D 5/08 72/181
6,460,388 B1 * 10/2002 Bowers ..... B21D 5/08 242/574.3
6,772,616 B2 * 8/2004 Cunningham ..... B21D 5/08 72/181
6,948,349 B2 * 9/2005 Gorski ..... B21D 5/08 72/181
7,536,889 B1 * 5/2009 Mueller ..... B21D 19/02 72/101
7,591,162 B2 * 9/2009 Meyer ..... B21D 5/08 72/181
8,601,845 B2 * 12/2013 Ingvarsson ..... B21D 5/08 72/181
2019/0201953 A1 * 7/2019 Cameron ..... B21B 39/02
2023/0187889 A1 * 6/2023 Sizemore ..... B29C 45/0013 439/736

OTHER PUBLICATIONS

New Tech Machinery, "Operation and Maintenance Manual MG5/MG6/MG56 Gutter Machines", obtained from url https://buymbs.com/images/New_Tech/NTMManual.pdf on Sep. 8, 2023.

Senox Corporation, Barracuda Reverse Bead Half Round Gutter Operating and Maintenance Trouble Shooting Guide, obtained from URL https://senox.com/wp-content/uploads/2014/09/06.04.13-barracuda-hr-gutter-machine-manual.pdf on Sep. 8, 2023.

* cited by examiner

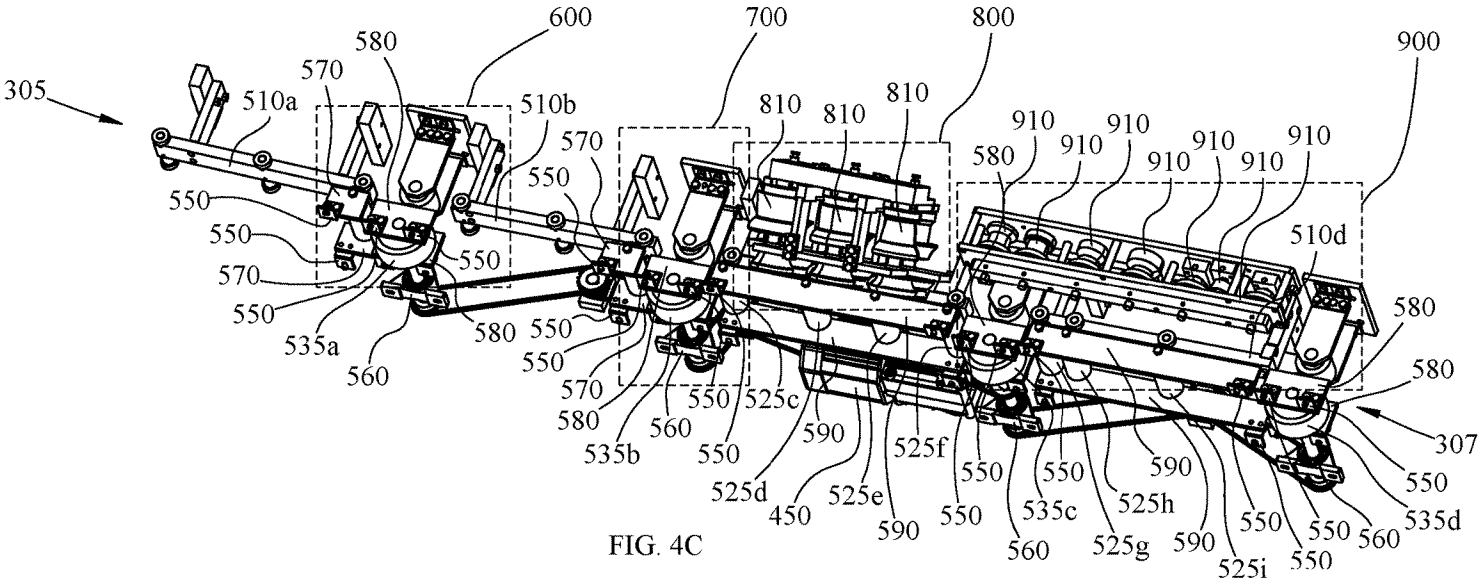
900
910
910
910
910
910
910
910
580
580
580
307
550
535d
560
550
550
550
525i
590
590
525h
525g
550
535c
560
550
550
525f
590
525e
590
450
525c
525d
550
550
560
535b
570
580
550
550
550
550
570
550
550
550
550
550
570
550
550
550
550
550

SECTION A-A

SECTION A-A

SECTION C-C

SECTION B-B

SECTION D-D

MULTI-SPEED LIGHTWEIGHT GUTTER MACHINE

BACKGROUND OF THE INVENTION

Rain gutters are used to direct rainwater away from a residential or commercial structure to protect its foundation and prevent flooding. Rain gutters are typically attached to the fascia boards under the roofline of the structure and direct rainwater from the roof's surface toward downsprouts that further direct the rainwater away from the structure toward drainage. Rain gutters prevent the accumulation of rainwater in low lying areas where rainwater would otherwise accumulate in the absence of gutters, prevent the absorption of rainwater by clay-rich soil that would otherwise retain rainwater near the foundation, and prevent flooding in basements or underground parking.

While rain gutters are primarily protective, they are a prominent and visible aspect of the elevation of a residential or commercial structure. As such, efforts are taken to enhance their aesthetic appeal. For example, rain gutters come in different shapes and sizes and are typically painted to match the color of the fascia that they are attached to. Because each roofline includes a number of linear segments, where each segment may vary in length, rain gutters are typically custom made for the structure on which they are installed. This permits the custom creation of seamless rain gutters that enhance the aesthetic appeal of the elevation. A seamless rain gutter is a rain gutter having a shape, size, and length that is custom made to fit linear segments of a particular roofline, thereby avoiding the appearance of unsightly seams.

Gutter machines are material fabricating/roll forming machines that advance rolled sheet metal against stainless steel forming elements that progressively shape the sheet metal into a desired cross-sectional gutter profile. Gutter machines are typically deployed on the job site to enable the creation of custom seamless rain gutters as they are being installed. Commercially available gutter machines include, for example, the KWM Gutterman Inc.® IronMan® Gutter Making Machine and the New Tech Machinery Corporation® Mach II® Gutter Machine.

SUMMARY OF THE INVENTION

According to one aspect of one or more embodiments of the present invention, a multi-speed lightweight gutter machine includes an aluminum frame having one or more hollow structural members, where one or more of the hollow structural members include one or more wiring access ports that provide access to the hollow interior of the frame, a transparent protective cover for the aluminum frame, a power unit that receives single-phase power, an inverter unit that converts single-phase power into three-phase power, a three-phase electric motor, a variable frequency drive unit that controls a speed of the electric motor by controlling a frequency of the three-phase power provided to the electric motor, a controller unit that controls the variable frequency drive unit, and a conveyance system driven by the electric motor that controllably moves material to be progressively formed through a plurality of forming stages. Each of the plurality of forming stages includes a plurality of lightweight structural support members composed of lightweight plastic. At least some of the plurality of forming stages include a plurality of lightweight forming wheels composed of lightweight plastic. Electrical components are connected by wiring at least partially routed in the hollow interior of the frame.

Other aspects of the present invention will be apparent from the following description and claims.

BRIEF DESCRIPTION OF DRAWINGS

FIG. 4C shows a bottom-facing left side perspective view of a motor-driven conveyance system and a plurality of forming stages a multi-speed lightweight gutter machine in accordance with one or more embodiments of the present invention.

FIG. 4D shows a bottom-facing right side perspective view of a motor-driven conveyance system and a plurality of forming stages of a multi-speed lightweight gutter machine in accordance with one or more embodiments of the present invention.

DETAILED DESCRIPTION OF THE INVENTION

Figure 1:
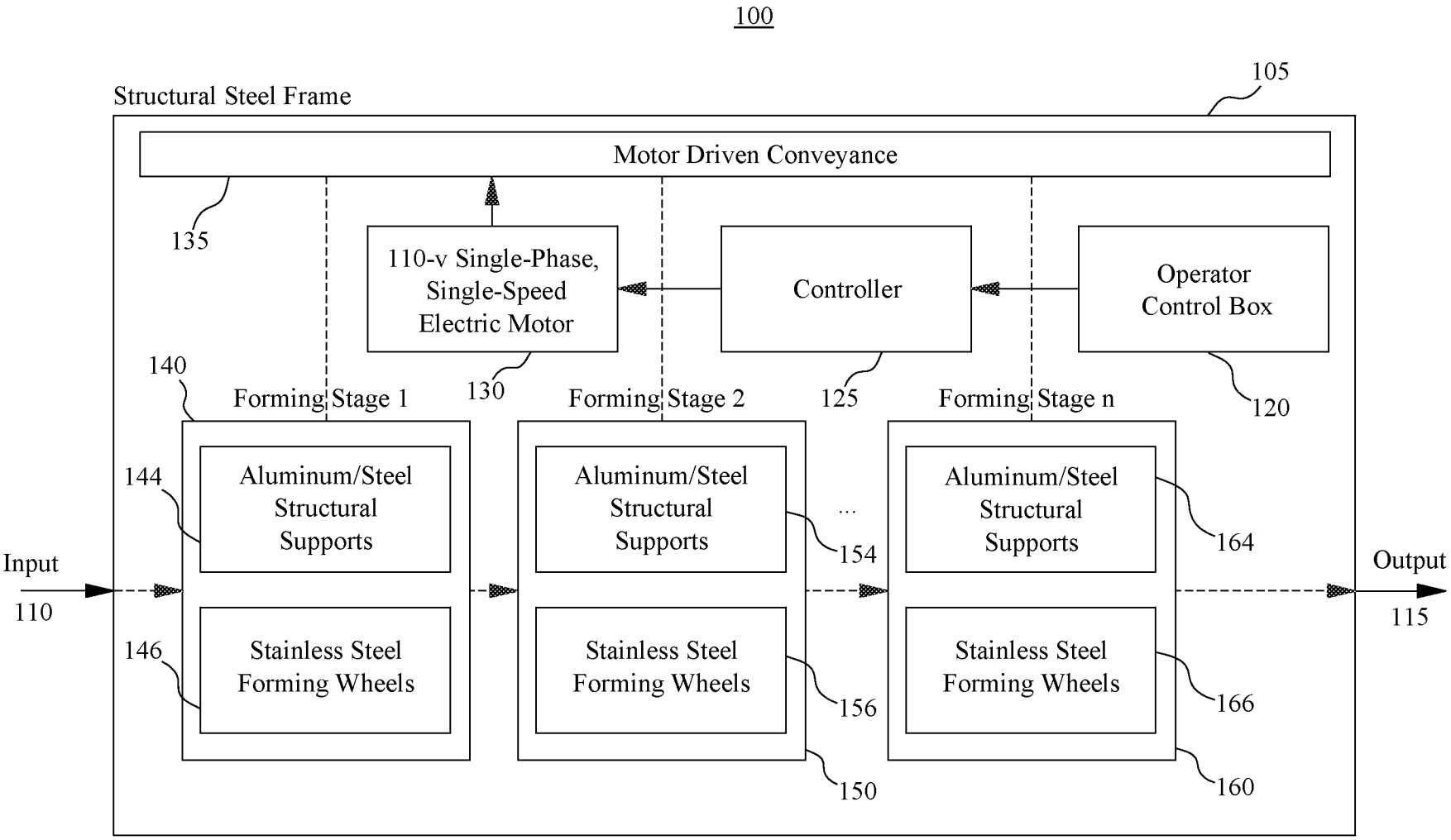
FIG. 1 PRIOR ART
FIG. 1 shows a block diagram of a conventional gutter machine.

One or more embodiments of the present invention are described in detail with reference to the accompanying figures. For consistency, like elements in the various figures are denoted by like reference numerals. In the following detailed description of the present invention, specific details are described to provide a thorough understanding of the present invention. In other instances, aspects that are well-known to those of ordinary skill in the art are not described to avoid obscuring the description of the present invention.

FIG. 1 shows a block diagram of a conventional gutter machine 100. Conventional gutter machine 100 includes a structural steel frame 105 having a rectangular shape with an interior area in which an operator control box 120, controller 125, a 110/120-volt, single-phase, single-speed electric motor 130, a conveyance system 135, and a plurality of forming stages (e.g., 140, 150, and 160) are disposed. The plurality of forming stages (e.g., 140, 150, 160) progressively shape raw material (not shown), such as sheet metal, that is fed through machine 100 to achieve a desired cross-sectional gutter profile (not shown). Each forming stage (e.g., 140, 150, 160) includes a plurality of aluminum/steel structural supports 144, 154, and 164 and at least some forming stages (e.g., 140, 150, 160) include a plurality of stainless steel or hard chrome plated steel forming wheels 146. 156, and 166. The number of forming stages (e.g., 140, 150, 160) may vary based on an application or design but is typically in a range between four and six stages for typical gutter applications.

An operator of gutter machine 100 may start or stop the forming process by depressing a jog-run button of operator control box 120, typically disposed near output end 115 gutter machine 100, or by programming controller 125 to produce a desired length of formed gutter (not shown). In operation, rolled sheet metal (not shown) is fed into input end 110 of gutter machine 100 and 110-volt, single-phase, single-speed electric motor 130 and conveyance system 135 drive the sheet metal through the plurality of forming stages (e.g., 140, 150, and 160) at a fixed speed where each stage progressively shapes the sheet metal into a desired cross-sectional gutter profile (not show). All wiring (not shown) between one or more of operator control box 120, controller 125, and 110/120-volt, single-phase, single-speed electric motor 130 is routed and exposed within the interior space of structural steel frame 105, near the conveyance components and the plurality of forming stages (e.g., 140, 150, 160) that include several moving parts. For safety reasons, a conventional gutter machine 100 such as, for example, the KWM Gutterman Inc.® IronMan® Gutter Making Machine and the New Tech Machinery Corporation® Mach II® Gutter Machine, include an opaque steel protective cover (not shown) that covers structural steel frame 105 to protect the forming stages (e.g., 140, 150, and 160) from outside interference and protect the safety of the operator of gutter machine 100.

While conventional gutter machines 100 are well known in the industry and have been in use for a number of decades, they suffer from a number of issues that limit their productivity, efficiency, and safe operation.

As previously discussed, conventional gutter machines 100 are designed for use on job sites so that the installer can create custom and seamless gutters for immediate installation. Conventional gutter machines 100 include a structural steel frame 105 that is a rectangular cage-like structure composed of steel, with a length in a range between approximately 90 and 120 inches and a width in a range between approximately 20 and 40 inches, such that gutter machine 100 can fit in the back of a work truck or tow-behind trailer. Structural steel frame 105 has a weight in a range between approximately 900 and 1200 pounds for the frame alone. Each of the forming stages (e.g., 140, 150, 160) include a plurality of support structures (e.g., 144, 154, 164) composed of aluminum or steel, where each support structure (e.g., 144, 154, 164) has a weight in a range between approximately 25 and 40 pounds. In addition, some of the forming stages (e.g., 140, 150, 160) includes a plurality of forming wheels (e.g., 146, 156, 166) composed of stainless steel or hard chrome plated steel, where each forming wheel (e.g., 146, 156, 166) has a weight in a range between approximately 75 and 110 pounds. As a consequence, conventional gutter machines 100 typically have a weight in a range between 900 and 1400 pounds, which does not include the weight of rolled coils of raw material that are used to create gutters. Each rolled coil of raw material may be composed of painted steel, galvalume, aluminized steel, terne coat steel, aluminum, or copper, and have a weight in a range between 400 and 600 pounds. Taken together, a conventional gutter machine 100 presents a substantial weighted load to a work truck or tow-behind trailer. As such, the weight of conventional gutter machine 100 negatively impacts fuel economy, the range of the work truck on a tank of gas, and the number of drops that a work truck can make in a given workday, thereby limiting productivity and efficiency.

Further, conventional gutter machines 100 use 110/120 v, single-phase, single speed electric motors that operate at a single speed that cannot be changed. For example, conventional gutter machines 100 use an electric motor having a rating between three-quarters and one horsepower. These electric motors are single-phase and operate at a fixed speed that limits production to approximately 25 to 50 feet of formed gutter per minute. As such, the operator does not have the ability to increase or modulate the speed of gutter machine 100, furthering limiting productivity and efficiency.

Further, conventional gutter machines 100 route wiring for electrical components within the interior space of structural steel frame 105. As such, the wiring is exposed and capable of movement due to vibration or other movement of conventional gutter machine 100 during transport or operation. Since the wiring is routed within the interior space of structural steel frame 105, there is a risk that the wiring will get caught up in one of the moving parts of the conveyance system 135 or the plurality of forming stages (e.g., 140, 150, 160). While some conventional gutter machines 100 include an opaque steel protective cover that protects outside objects from falling within the interior space of structural steel frame 105, the wiring in the interior space of structural steel frame 105 is still subject to vibration or movement during transport or operation.

Advantageously, in one or more embodiments of the present invention, a multi-speed lightweight gutter machine weighs significantly less than a conventional gutter machine. Conventional gutter machines use a structural steel frame, a plurality of support structures, and a plurality of forming wheels composed of heavy steel material. In contrast, a multi-speed lightweight gutter machine includes a lightweight aluminum frame that weighs approximately one-third as much as a structural steel frame, or less. In addition, a multi-speed lightweight gutter machine includes a plurality of support structures and a plurality of forming wheels composed of lightweight plastic that each weigh approximately one-quarter or less than the corresponding aluminum/steel support structures and stainless steel/hard chrome plated steel forming wheels used in a conventional gutter machine. Taken together, a multi-speed lightweight gutter machine weighs approximately one-third as much as a conventional gutter machine, or less. The reduced weight of a multi-speed lightweight gutter machine reduces the load on a work truck or tow-behind trailer used to transport it, significantly increases fuel economy, permits a work truck to service more job sites or more distant job sites in a given workday, and increases the number of drops that may be achieved in a given workday.

Further, in one or more embodiments of the present invention, a multi-speed lightweight gutter machine can operate at a substantially faster forming speed than that of a conventional gutter machine, thereby improving productivity and efficiency. Conventional gutter machines use a 110/120 v single-phase, single-speed electric motor, typically rated at three-quarter or one horsepower, that is capable of operating at a single speed. In contrast, a multi-speed lightweight gutter machine uses a controller unit, a 110/120 v single-phase to 220/230 v three-phase inverter unit, a variable frequency drive unit, and a three-phase electric motor that enables substantially faster forming speeds than that of a conventional gutter machine. While conventional gutter machines are capable of producing approximately 25 to 50 feet per minute of formed cross-sectional profile gutters, a multi-speed lightweight gutter machine is capable of operating approximately 20 to 25 percent faster than conventional gutter machines and have the ability to operate at slower speeds should it be desired, or necessary, to do so. Further, the operator of a multi-speed lightweight gutter machine can adjust the speed of the variable frequency drive electric motor and thereby dictate the forming speed of multi-speed lightweight gutter machine based on an application or design.

Further, in one or more embodiments of the present invention, a multi-speed lightweight gutter machine is more robust and reliable than a conventional gutter machine. Conventional gutter machines include wiring harnesses that are exposed and routed in the interior area of the structural steel frame in areas near moving parts including the conveyance system, the sheet metal advancing through the progressive forming stages, and the forming stages themselves. While the wiring is typically routed out of the way of these moving parts, conventional gutter machines are disposed in the back of a work truck or on a tow-behind trailer and transported from job site to job site. often servicing several job sites in a single workday. As such, conventional gutter machines are subjected to significant vibration and movement that can inadvertently cause exposed wiring to move and unintentionally come into contact with moving parts, typically resulting in complete failure of the conventional gutter machine. In contrast, multi-speed lightweight gutter machine includes a lightweight aluminum frame that is hollow and includes a plurality of wiring access ports in at least some hollow structural members. This enables the routing of wiring harnesses internal to the hollow structural members of the lightweight aluminum frame, such that wiring between one or more operator control boxes, the controller unit, the 110/120 v single-phase to 220/230 v three-phase inverter unit, the variable frequency drive unit, and the three-phase electric motor are primarily routed inside the hollow structural members of the lightweight aluminum frame and cannot come into contact with moving parts, with only limited runs of wiring exposed within in the interior area of the lightweight aluminum frame. Advantageously, multi-speed lightweight gutter machine is more robust and reliable, capable of withstanding the vibration and movement of transport and operation.

Further, in one or more embodiments of the present invention, a multi-speed lightweight gutter machine includes safety features to enhance the safe operation of the machine and the safety of the operator. Conventional gutter machines typically do not include a protective cover. As such, a loose object within the back of the work truck may inadvertently fall into the interior area of the conventional gutter machine during transport. When the conventional gutter machine is later operated on the job site, the object may come into contact with a moving part and may be ejected as a projectile, potentially damage components of the conventional gutter machine itself, or seize up the conveyance system or electric motor of the conventional gutter machine. Some conventional gutter machines include protective covers that protect the interior area of the gutter machine; however, these protective covers are composed of opaque steel and are fixed in place. While these covers protect the interior area of the conventional gutter machine, they significantly increase the weight of the machine, prevent the operator from observing the internal operation of the machine while forming, and prevent the operator from monitoring or easily servicing the machine. In contrast, a multi-speed lightweight gutter machine includes a removably attached lightweight transparent protective cover. The lightweight transparent protective cover weighs substantially less than steel, further promoting fuel economy. In addition, the lightweight transparent protective cover provides the same protection as an opaque steel protective cover, but advantageously allows the operator to monitor the internal operation of the machine while forming and allows the operator to easily remove the protective cover to service the machine. A controller unit of multi-speed lightweight gutter machine may also include a remotely controllable latch that controls the removal of the lightweight transparent protective cover and a sensor that indicates a status as to whether the protective cover is installed or not. In the event the sensor detects that the protective cover is not safely installed in place, the controller unit may prevent the multi-speed lightweight gutter machine from operating to protect the operator from potential harm.

Further, in one or more embodiments of the present invention, a multi-speed lightweight gutter machine costs substantially less to manufacture than a conventional gutter machine. Given the large amount of steel content in critical components of a conventional gutter machine, including the structural steel frame and the plurality of stainless steel forming wheels, the cost to manufacture a conventional gutter machine is heavily influenced by skyrocketing prices for raw steel. In contrast, a multi-speed lightweight gutter machine uses a hollow lightweight aluminum frame and a plurality of lightweight forming wheels composed of lightweight plastic material, thereby substantially reducing the expensive steel content of the multi-speed lightweight gutter machine, and associated raw material costs. As such, the cost to manufacture a multi-speed lightweight gutter machine is substantially less than that of a conventional gutter machine.

Further, in one or more embodiments of the present invention, a multi-speed lightweight gutter machine costs substantially less to maintain than a conventional gutter machine. Due to the high cost of the steel content of various components, including the plurality of stainless steel forming wheels of a conventional gutter machine, removing, servicing, and replacing stainless steel forming wheels is very expensive. In contrast, a multi-speed lightweight gutter machine includes a number of components, including a plurality of lightweight forming wheels composed of inexpensive lightweight plastic material that is comparatively inexpensive. As such, the cost to maintain the multi-speed lightweight gutter machine is substantially less than that of a conventional gutter machine.

Further, in one or more embodiments of the present invention, a multi-speed lightweight gutter machine costs substantially less to operate than a conventional gutter machine. As previously discussed, the reduced steel content of a multi-speed lightweight gutter machine substantially reduces its weight compared to a conventional gutter machine which reduces the load on the work truck or tow-behind trailer that is used to transport the multi-speed lightweight gutter machine, thereby reducing fuel consumption and operating costs. In addition, given the reduced fuel consumption, coupled with the increased operating speed of the motor system, operators can service more jobs on a single tank of gas or given workday, further reducing operating costs.

Figure 2:
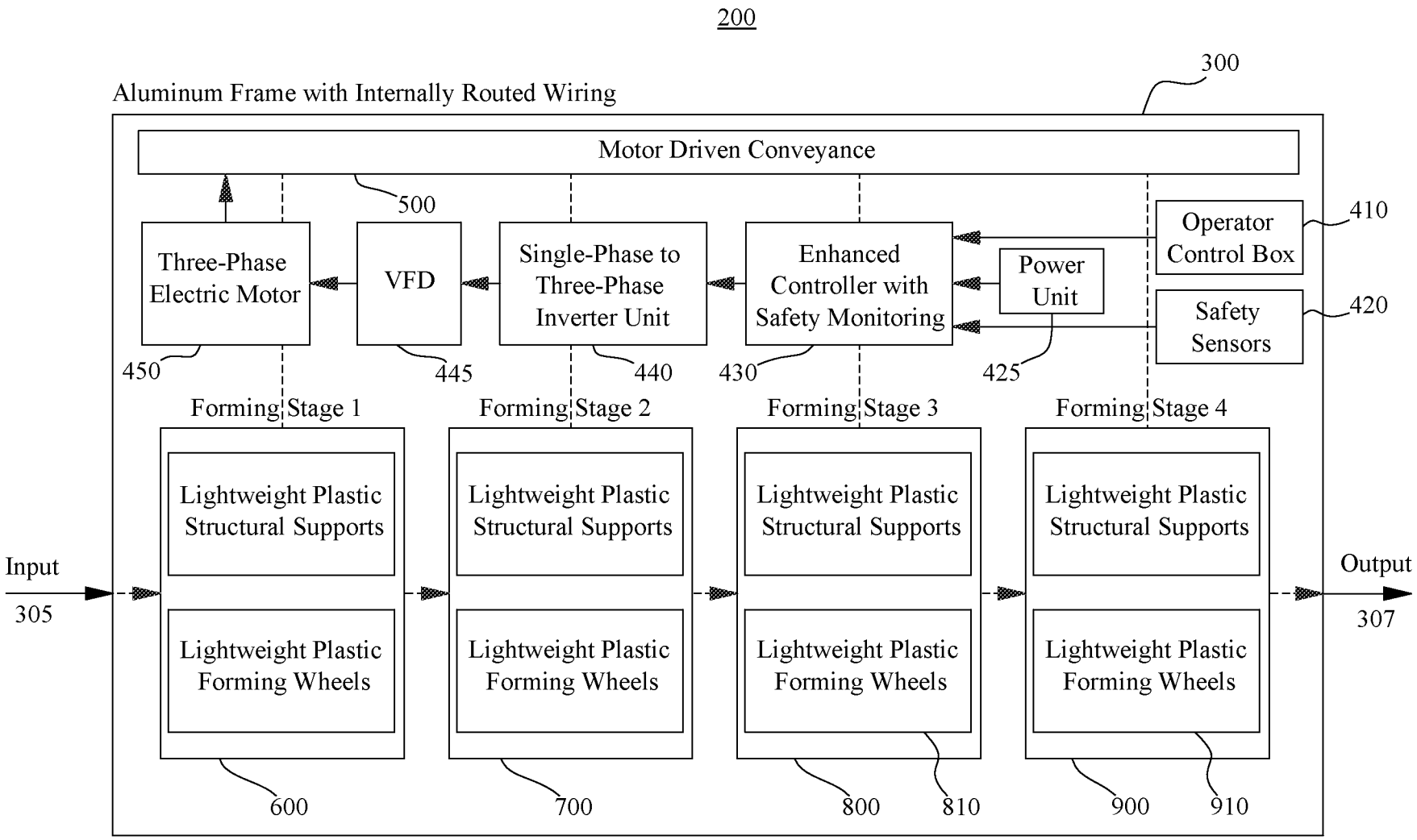
FIG. 2 shows a block diagram of a multi-speed lightweight gutter machine in accordance with one or more embodiments of the present invention.

FIG. 2 shows a block diagram of a multi-speed lightweight gutter machine 200 in accordance with one or more embodiments of the present invention. A multi-speed lightweight gutter machine 200 may include a lightweight aluminum frame 300 having a having an input end 305 and an output end 307. Multi-speed lightweight gutter machine 200 may further include a power unit 425, a controller unit 430, a 110 v/120 v single-phase to 220 v/230 v three-phase inverter unit 440, a variable frequency drive unit 445, and a three-phase electric motor 450. Power unit 425 receives single-phase power that may be used to power various single-phase components including, for example, controller unit 430 and inverter unit 440. Inverter unit 440 may convert single-phase input power into three-phase output power. Variable frequency drive unit 445 may control a speed of three-phase electric motor 450 by controlling a frequency of the three-phase power to three-phase electric motor 450. Controller unit 430 controls variable frequency drive unit 445 by commanding it to a user-selected speed. Conveyance system 500 may be driven by three-phase electric motor 450 and controllably move raw material that is progressively formed through a plurality of successive forming stages 600, 700, 800, 900. Each of the plurality of forming stages 600, 700, 800, 900 may include a plurality of lightweight structural support members (e.g., 550, 560, 570, 580, 590), a plurality of lightweight flintstone transfer rollers (not shown), and at least some of the forming stages may include a plurality of lightweight forming wheels 810, 910 composed of lightweight plastic.

In certain embodiments, the lightweight plastic may be Electra Plastic® manufactured by Electra Shield, Inc. of Hamilton, Ohio and protected by U.S. Pat. Nos. 11,139,630, 11,527,862, and pending U.S. patent application Ser. No. 18/079,835, all of which are incorporated by reference in their entirety. Electra Plastic® weighs approximately one-quarter as much as steel material, or less. In other embodiments, the lightweight plastic may be composed of a lightweight plastic, polymer, alloy, or composite composition thereof, having a tensile hardness of at least 27,000 pounds per square inch ("psi") that weighs one-third as much as steel material, or less. One of ordinary skill in the art will recognize that the lightweight plastic material may vary in composition so long as it has a tensile hardness of at least 27,000 psi and weighs one-third as much as steel material, or less.

Figures 3A, 3B:
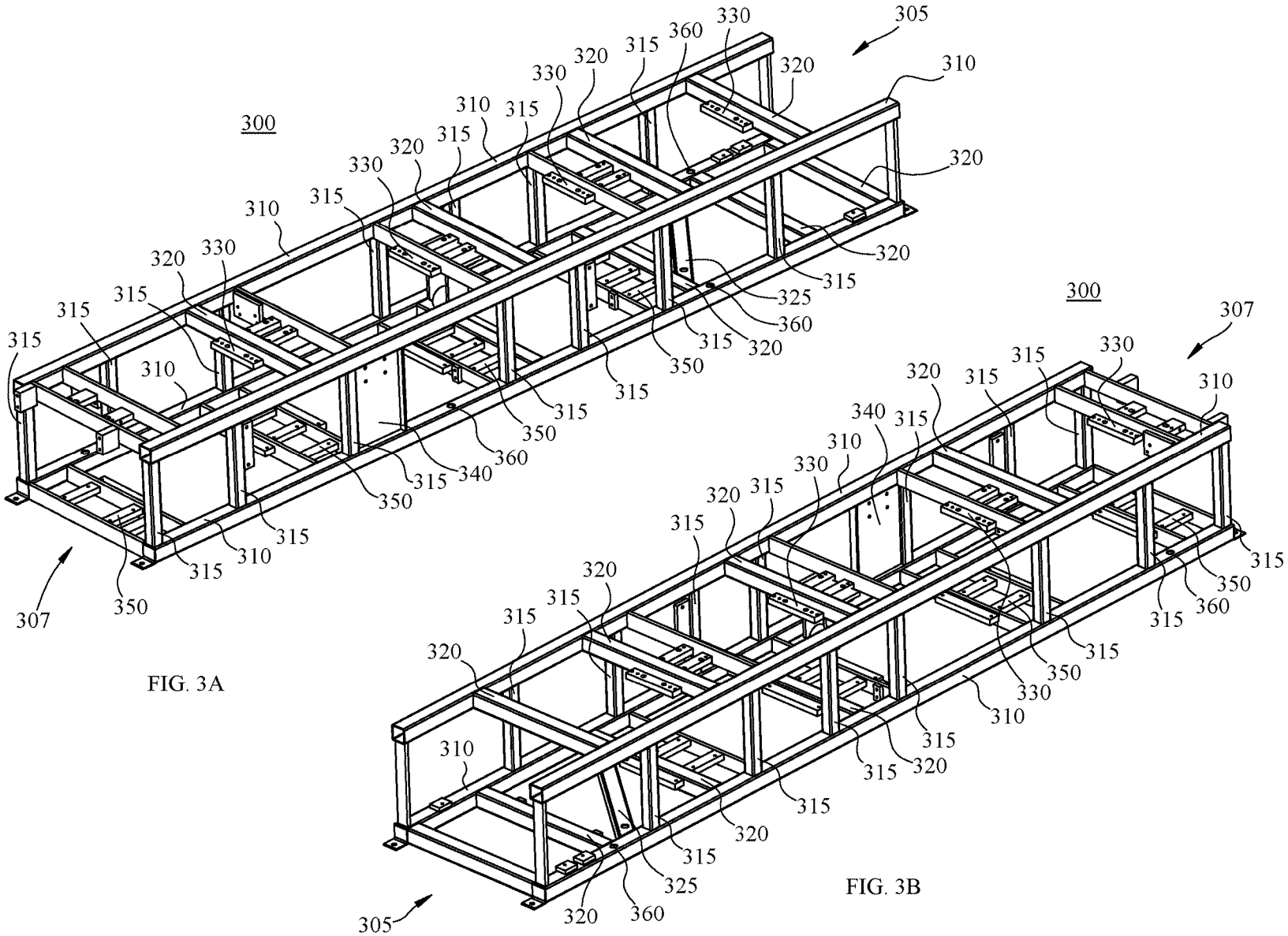
FIG. 3A shows a top-facing perspective view of an output end of a lightweight aluminum frame of a multi-speed lightweight gutter machine in accordance with one or more embodiments of the present invention.
FIG. 3B shows a top-facing perspective view of an input end of a lightweight aluminum frame of a multi-speed lightweight gutter machine in accordance with one or more embodiments of the present invention.

FIG. 3A shows a top-facing perspective view of an output end 307 of a lightweight aluminum frame 300 of a multi-speed lightweight gutter machine (e.g., 200) in accordance with one or more embodiments of the present invention. Lightweight aluminum frame 300 may include a plurality of longitudinal rails 310, a plurality of support columns 315, and a plurality of transverse cross bars 320 that are welded together to form a substantially rectangular-shaped cage as shown. Lightweight aluminum frame 300 may include one or more hollow structural members (e.g., 310, 315, 320, 325) that include one or more wiring access ports 360 that provide access to the hollow inside of frame 300 for routing wiring harnesses (not shown). Lightweight aluminum frame 300 may further include a plurality of mounts such as, for example, top-side weldment mounts 330, side motor mount 340, and lower weldment mounts 350 that are operatively used to provide structural support or connect various components to lightweight aluminum frame 300.

Figures 3C, 3D:
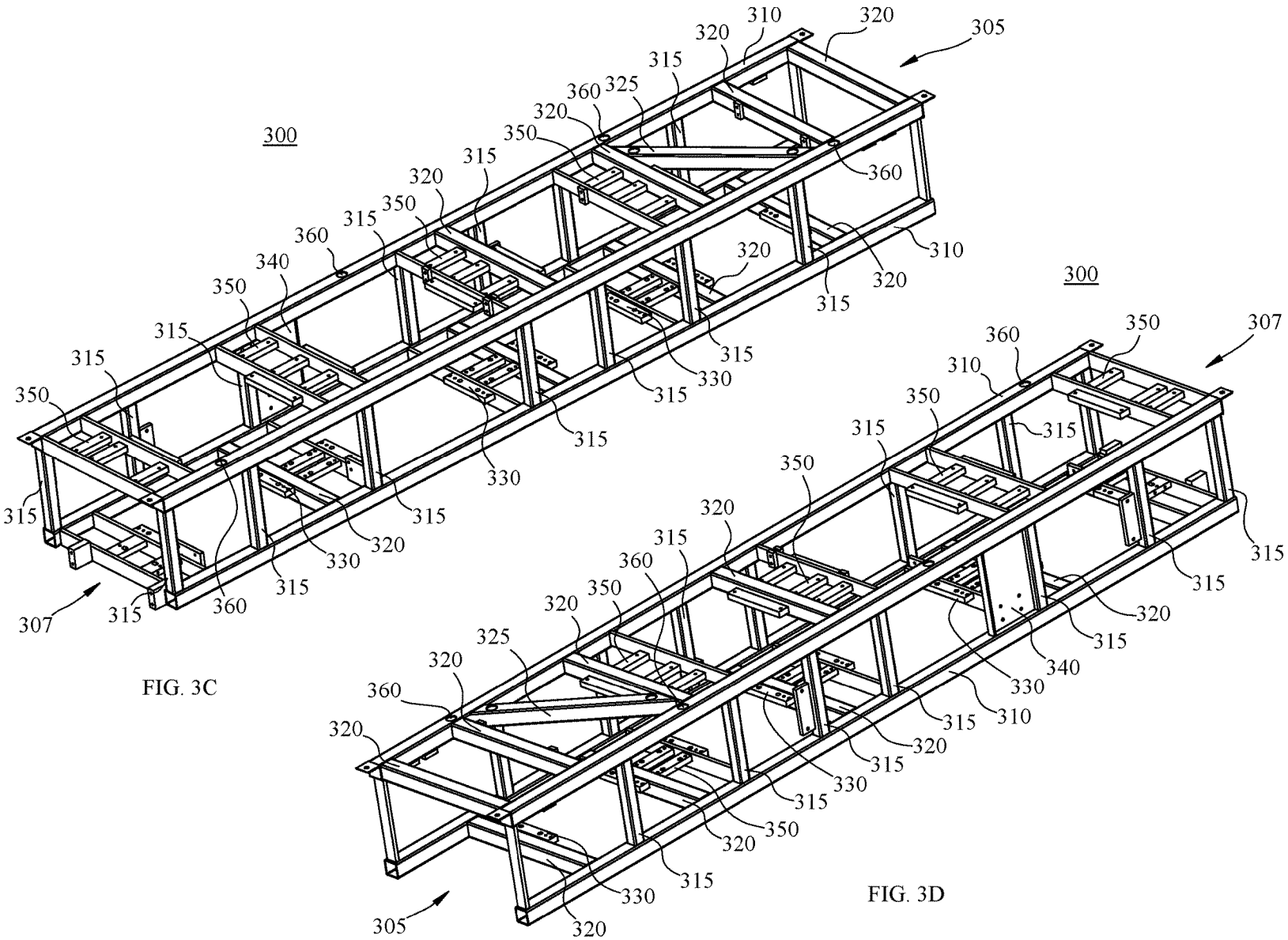
FIG. 3C shows a bottom-facing perspective view of an output end of a lightweight aluminum frame of a multi-speed lightweight gutter machine in accordance with one or more embodiments of the present invention.
FIG. 3D shows a bottom-facing perspective view of an input end of a lightweight aluminum frame of a multi-speed lightweight gutter machine in accordance with one or more embodiments of the present invention.

Continuing, FIG. 3B shows a top-facing perspective view of an input end 305 of a lightweight aluminum frame 300 of a multi-speed lightweight gutter machine (e.g., 200) in accordance with one or more embodiments of the present invention. Input end 305 may include space for mounting a rolled coil of raw material (not shown) and an input guide (not shown) that feeds raw material into the gutter machine (e.g., 200). Continuing, FIG. 3C shows a bottom-facing perspective view of an output end 307 of a lightweight aluminum frame 300 of a multi-speed lightweight gutter machine (e.g., 200) in accordance with one or more embodiments of the present invention. Lightweight aluminum frame 300 may further include one or more Y-cross bars 325 as needed to provide necessary structural support, mounting support, or wire routing options. Continuing. FIG. 3D shows a bottom-facing perspective view of an input end 305 of a lightweight aluminum frame 300 of a multi-speed lightweight gutter machine (e.g., 200) in accordance with one or more embodiments of the present invention.

Figure 3E:
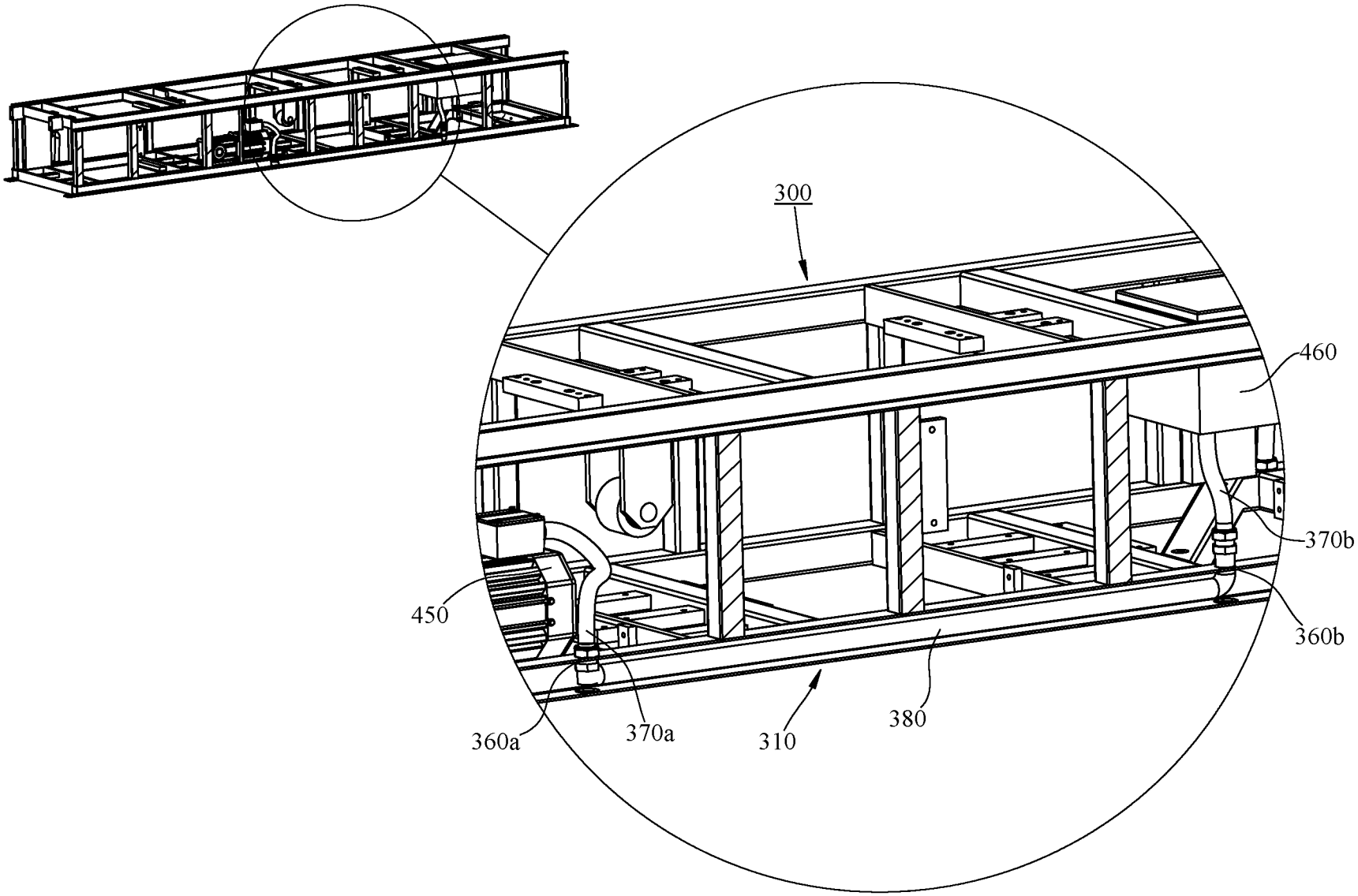
FIG. 3E shows a detailed perspective view of wiring routed inside hollow structural members of a lightweight aluminum frame of a multi-speed lightweight gutter machine in accordance with one or more embodiments of the present invention.

Continuing, FIG. 3E shows a detailed perspective view of wiring (e.g., 380 as shown) routed inside hollow structural members (e.g., 310 as shown) of a lightweight aluminum frame 300 of a multi-speed lightweight gutter machine (e.g., 200) in accordance with one or more embodiments of the present invention. As previously discussed, lightweight aluminum frame 300 incudes a plurality of hollow structural members (e.g., 310, 315, 320, 325) that include one or more wiring access ports 360*a*. 360*b* that provide access to the hollow interior of frame 300 for routing wiring harnesses (e.g., 380 as shown). In the detailed perspective view, three-phase electric motor 450 may be electrically connected to one or more components disposed in electrical control box 460, including, for example, a controller unit (not shown) and a variable frequency drive unit (not shown). In the example depicted, wiring harness 370*a* may include a short hop of wiring that connects three-phase electric motor 450 to a connector of a first wiring access port 360*a*. A wiring harness 380 may be routed inside longitudinal rail 410 and connect first wiring access port 360*a* to a second wiring access port 360*b*. Wiring harness 370*b* may include a short hop of wiring that connects second wiring access port 360*b* to electrical control box 460 and one or more of the components disposed therein (not shown). As shown, routing wiring in the hollow interior of structural support members (e.g., 310, 315, 320, 325) substantially reduces the exposure of wiring to the internal area of the gutter machine (e.g., 200) and the moving parts (not shown) disposed therein, thereby enhancing the resiliency and the reliability of its operation.

Figure 3G:
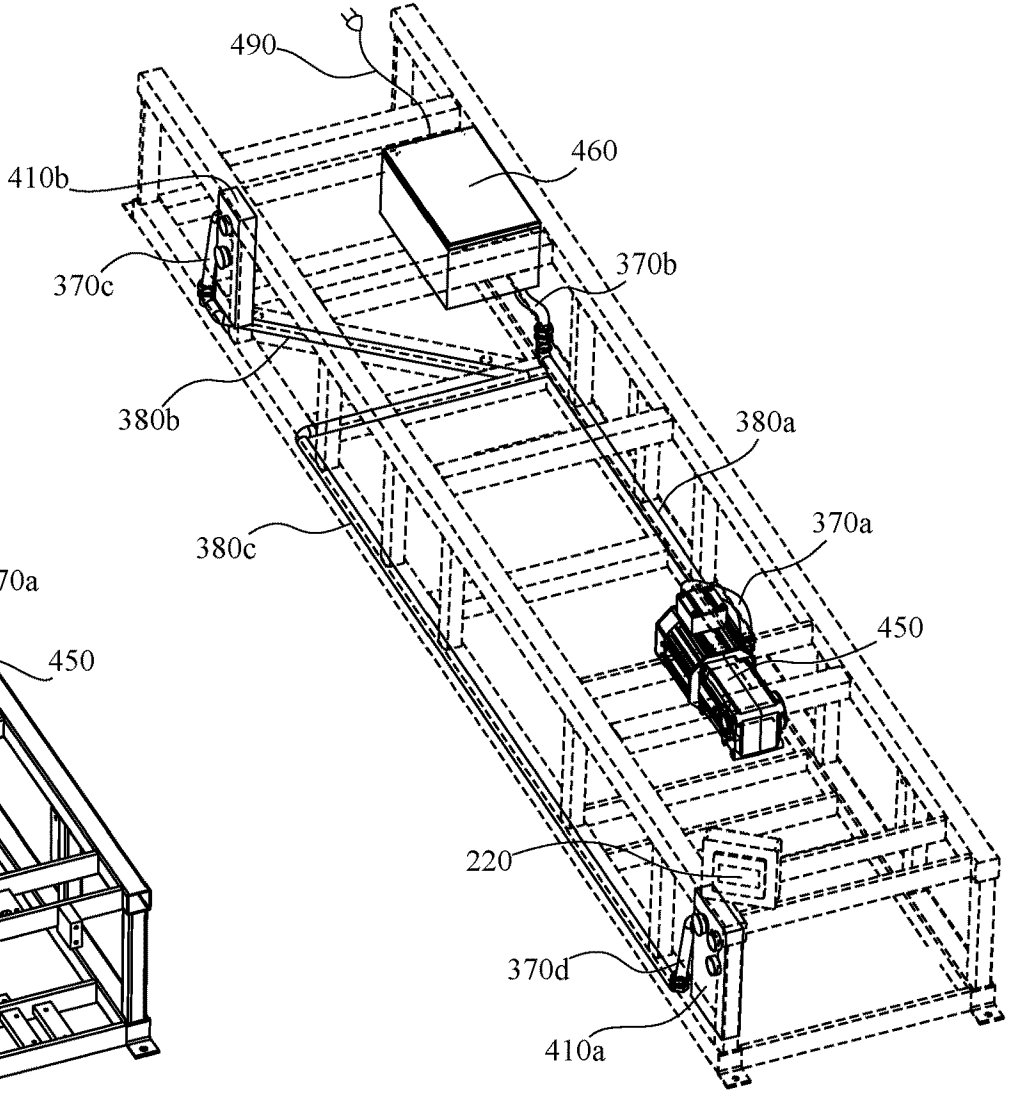
FIG. 3G shows a top-facing perspective view of an output end of several wired components of a multi-speed lightweight gutter machine showing electrical connectivity in accordance with one or more embodiments of the present invention.
Figure 3F:
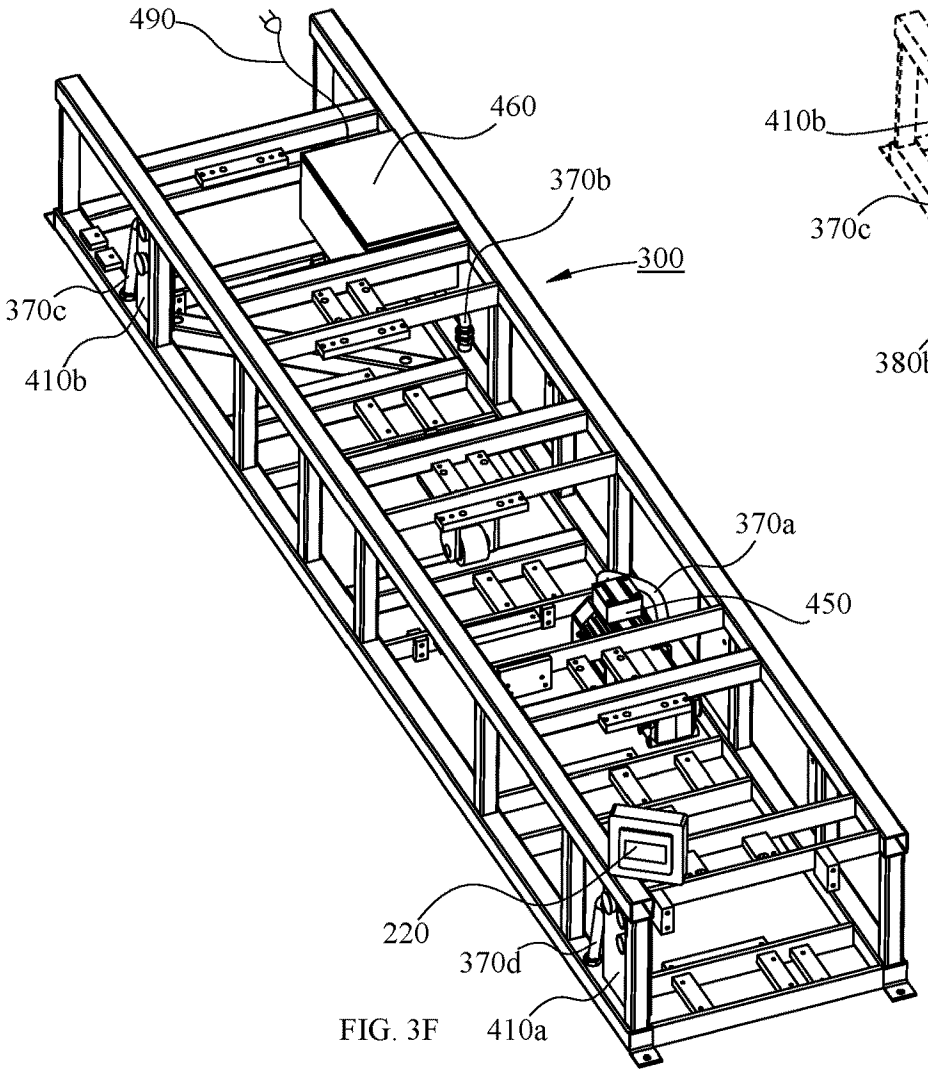
FIG. 3F shows a top-facing perspective view of an output end of a lightweight aluminum frame of a multi-speed lightweight gutter machine with several wired components disposed within an interior area of the frame and electrically connected by wiring disposed within hollow structural members of the frame in accordance with one or more embodiments of the present invention.

Continuing. FIG. 3F shows a top-facing perspective view of an output end 307 of a lightweight aluminum frame 300 of a multi-speed lightweight gutter machine (e.g., 200) with several electrical components disposed within an interior area of the frame 300 and electrically connected by wiring disposed primarily within hollow structural members (e.g., 310, 315, 320, 325) of the frame 300 in accordance with one or more embodiments of the present invention. As shown, the vast majority of the wiring is not visible because it is routed through the interior of the hollow structural members (e.g., 310, 315, 320, 325). Continuing. FIG. 3G shows a top-facing perspective view of an output end 307 of several electrical components of a multi-speed lightweight gutter machine (e.g., 200) showing electrical connectivity in accordance with one or more embodiments of the present invention. In this view and in comparison, to that of FIG. 3F. the wiring routed inside the hollow structural members (e.g., 310, 315, 320, 325) can be more easily appreciated. A short hop wiring harness 370*a* may connect three-phase electric motor 450 to a first wiring access port (e.g., 360*a*). A wiring harness 380*a* may connect the first wiring access port (e.g., 360*a*) to a second wiring access port (e.g., 360*b*). A wiring harness 380*a* may be routed inside the hollow structural member of frame 300 and connect the first wiring access port (e.g., 360*a*) to the second wiring access port (e.g., 360*b*). A short wiring harness 370*b* may connect the second wiring access point (e.g., 360*b*) to electrical control box 460 and one or more devices disposed therein (not shown). A wiring harness 380*b* may be routed inside a Y-crossbar (e.g., 325) to an operator control box 410 disposed on an input end (e.g., 305) of the gutter machine (e.g., 200). A wiring harness 380*c* may be routed inside a transverse crossbar (e.g., 320) and a longitudinal rail (e.g., 310) to an operator control box 410*a* disposed on an output end (e.g., 307) of the gutter machine (e.g., 200). One of ordinary skill in the art having the benefit of this disclosure will appreciate that the electrical connectivity is merely exemplary and other electrical connectivity may be established in accordance with one or more embodiments of the present invention.

Figure 4A:
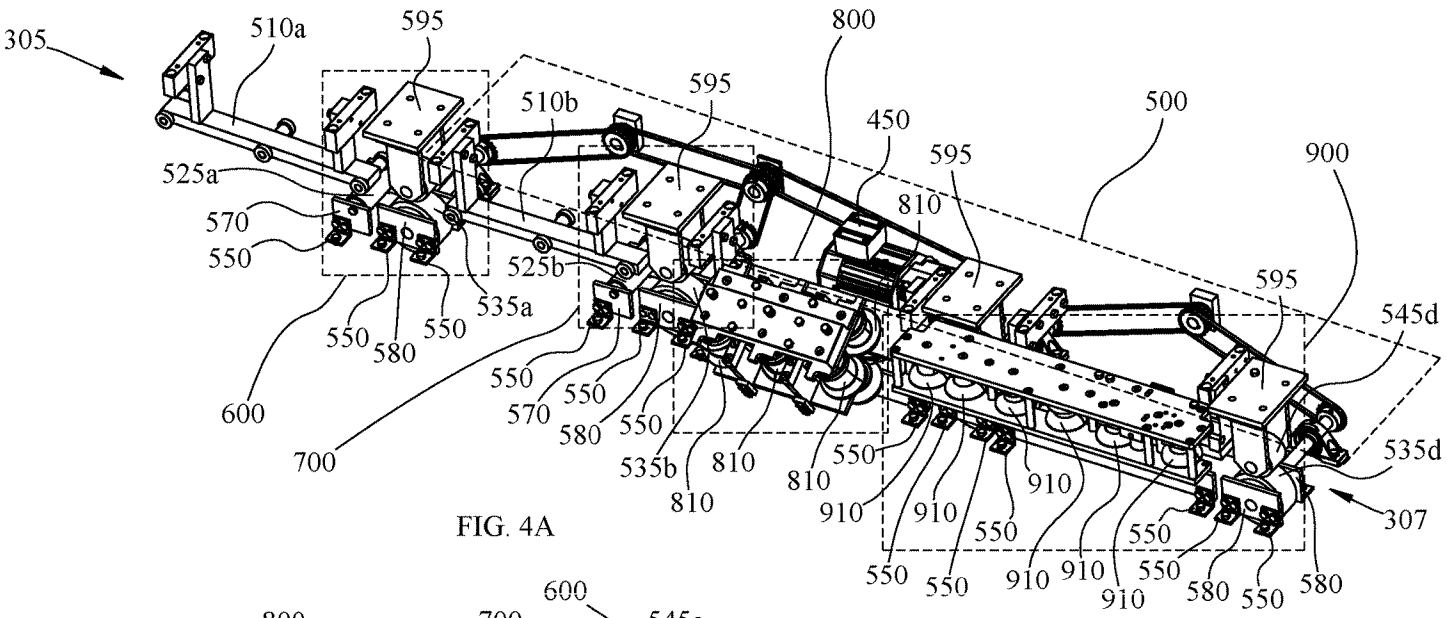
FIG. 4A shows a top-facing left side perspective view of a motor-driven conveyance system and a plurality of forming stages of a multi-speed lightweight gutter machine in accordance with one or more embodiments of the present invention.

FIG. 4A shows a top-facing left side perspective view of a motor-driven conveyance system 500 and a plurality of forming stages 600, 700, 800, 900 of a multi-speed lightweight gutter machine (e.g., 200) in accordance with one or more embodiments of the present invention. While these components of a multi-speed lightweight gutter machine (e.g., 200) are mounted within an interior area of the lightweight aluminum frame (e.g., 300), the frame (e.g., 300) is not shown to enhance the clarity and understanding of the description that follows.

A multi-speed lightweight gutter machine (e.g., 200) includes a conveyance system 500 driven by three-phase electric motor 450 that controllably moves raw material (not shown) through a plurality of forming stages (e.g., 600, 700, 800, 900) that progressively shape the raw material (not shown) into a desired cross-sectional gutter profile (not shown). As previously discussed, a number of components of a multi-speed lightweight gutter machine (e.g., 200) may be composed of lightweight plastic to substantially reduce its weight. For example, one or more of mounting bracket 550, axle mounting bracket 560, small structural support member 570, medium structural support member 580, large structural support member 590, lightweight flintstone transfer rollers (e.g., 525*a*-525*i*), and lightweight forming wheels (e.g., 810, 910) may be composed of lightweight plastic.

Figure 4B:
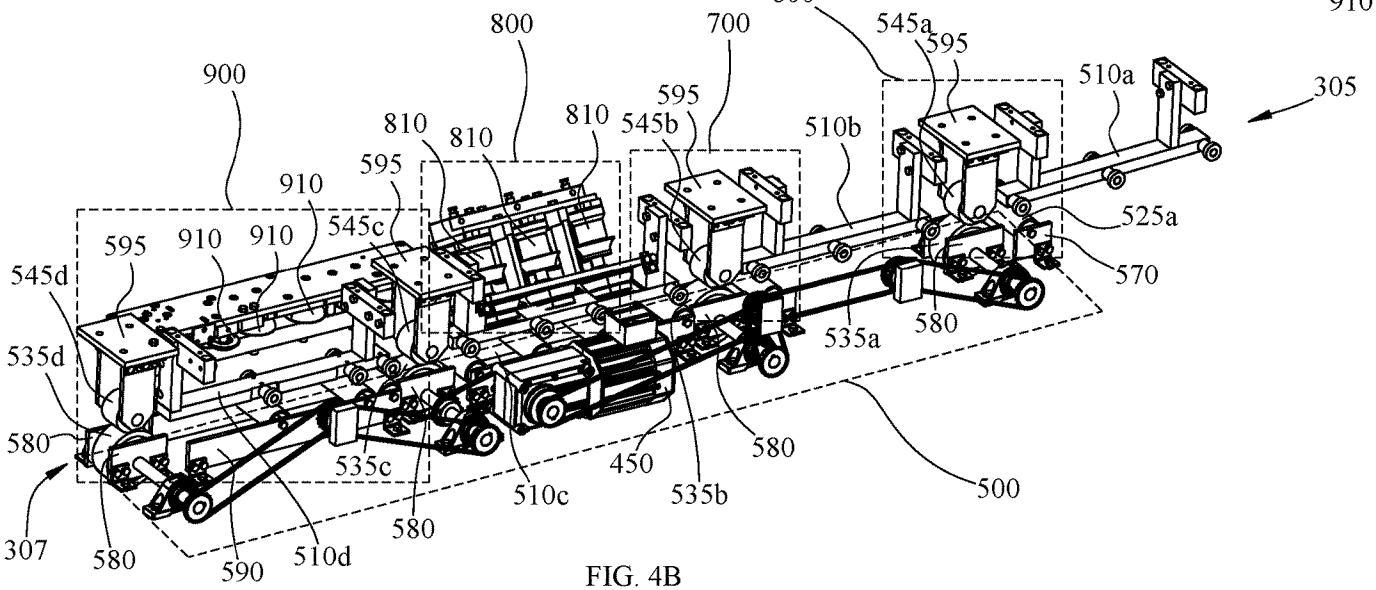
FIG. 4B shows a top-facing right side perspective view of a motor-driven conveyance system and a plurality of forming stages of a multi-speed lightweight gutter machine in accordance with one or more embodiments of the present invention.

Continuing, FIG. 4B shows a top-facing right side perspective view of a motor-driven conveyance system 500 and a plurality of forming stages 600, 700, 800, 900 of a multi-speed lightweight gutter machine (e.g., 200) in accordance with one or more embodiments of the present invention. In certain embodiments, the raw material (not shown) may enter input end 305 of the gutter machine (e.g., 200) and is fed under skate 510*a* and above lightweight flintstone transfer roller 525*a* and drawn forward by motor-driven lower rubber wheel 535*a*, where motor-driven lower rubber wheel 535*a* and upper rubber wheel 545*a* form an interference fit with the raw material (not shown) disposed therebetween. The raw material (not shown) continues to travel under skates 510*b*-510*d* and above lightweight flintstone rollers 525*b*-525*i* while being drawn forward by motor-driven lower rubber wheels 535*b*-535*d* and their corresponding upper rubber wheels 445*b*-445*d*.

Each skate 510*a*-510*d* is a substantially rectangular member having a plurality of free-rolling wheels and is so named because it resembles a roller skate. Each lower rubber wheel 535*a*-535*d* and its corresponding upper rubber wheel 545*a*-545*d* are composed of rubber material. Lower rubber wheels 535*a*-535*d* may be secured to the bottom of the frame (e.g., 300) by lightweight structural support 580 and a plurality of lightweight mounting brackets 550 that are bolted into place. Upper rubber wheels 545*a*-545*d* may be secured to the top of the frame (e.g., 300) by upper rubber wheel mount 595. Motor-driven lower rubber wheels 535*a*-535*d* and upper rubber wheels 545*a*-545*d* may be positioned relative to one another such that they create an interference fit with raw material (not shown) disposed therebetween.

In operation, motor-driven lower rubber wheels 535*a*-535*d* draw raw material (not shown) forward through first forming stage 600, second forming stage 700, third forming stage 800, and fourth forming stage 900, where each stage progressively shapes the raw material into a desired cross-sectional gutter profile (not shown). In this way, an operator may produce a desired length of seamless gutter having the desired cross-sectional gutter profile (not shown). Each forming stage 600, 700, 800, 900 may include a plurality of lightweight structural support members (e.g., 550, 560, 570, 580, 590), a plurality of lightweight flintstone transfer rollers (e.g., 525*a*-525*i*), and at least some forming stages include a plurality of lightweight forming wheels 810, 910 that are composed of lightweight plastic. While the embodiment depicted includes four forming stages, one of ordinary skill in the art, having the benefit of this disclosure, will appreciate that the number of forming stages, associated support structures, skates, flintstone transfer rollers, lightweight forming wheels, lower rubber wheels, and upper rubber wheels may vary based on an application or design in accordance with one or more embodiments of the present invention.

Continuing, FIG. 4C shows a bottom-facing left side perspective view of a motor-driven conveyance system 500 and a plurality of forming stages 600, 700, 800, 900 of a multi-speed lightweight gutter machine (e.g., 200) in accordance with one or more embodiments of the present invention. In this view, left and right side lightweight structural support members 570 are more clearly shown providing support to lightweight flintstone transfer roller 525*a* and left and right side lightweight structural support members 570 are shown providing support to lightweight flintstone transfer roller 525*b*. Similarly, left and right side lightweight structural members 590 are shown providing support to lightweight flintstone transfer rollers 525*c*-525*f* and left and right side lightweight structural members 590 are shown providing support to lightweight flintstone transfer rollers 525*g*-525*i*. Lightweight structural support members 570, 590 and flintstone transfer rollers 525*a*-525*f* provide bottom side support for the raw material (not shown) progressing through the machine (e.g., 200).

Continuing. FIG. 4D shows a bottom-facing right side perspective view of a motor-driven conveyance system 500 and a plurality of forming stages 600, 700, 800, 900 of a multi-speed lightweight gutter machine (e.g., 200) in accordance with one or more embodiments of the present invention. In this view, the material path of conveyance system 500 is more clearly shown. Raw material (not shown) may be inserted under skate 510*a* and above lightweight flintstone roller 525*a* and forms an interference fit with motor-driven lower rubber wheel 535*a* and upper rubber wheel 545*a* of first forming stage 600. As such, motor-driven lower rubber wheel 535*a* initially advances the raw material (not shown) into the gutter machine (e.g., 200). The raw material (not shown) continues under skate 510*b* and above lightweight flintstone roller 525*b* and forms an interference fit with motor-driven lower rubber wheel 535*b* and upper rubber wheel 545*b* of second forming stage 700. The raw material (not shown) continues under skate 510*c* (not shown in this view) and above lightweight flintstone rollers 525*c*-525*f*, proceeds through a plurality of lightweight forming wheels 810 (not shown in this view), and forms an interference fit with motor-driven lower rubber wheel 535*c* and upper rubber wheel 545*c* (not shown in this view) of third forming stage 800. The raw material (not shown) continues under skate 510*d* (not shown in this view) and above lightweight flintstone rollers 525*g*-525*i*, proceeds through a plurality of lightweight forming wheels 910 (not shown in this view), and forms an interference fit with motor-driven lower rubber wheel 535*d* and upper rubber wheel 545*d* (not shown in this view) of fourth forming stage 900.

Figure 4E:
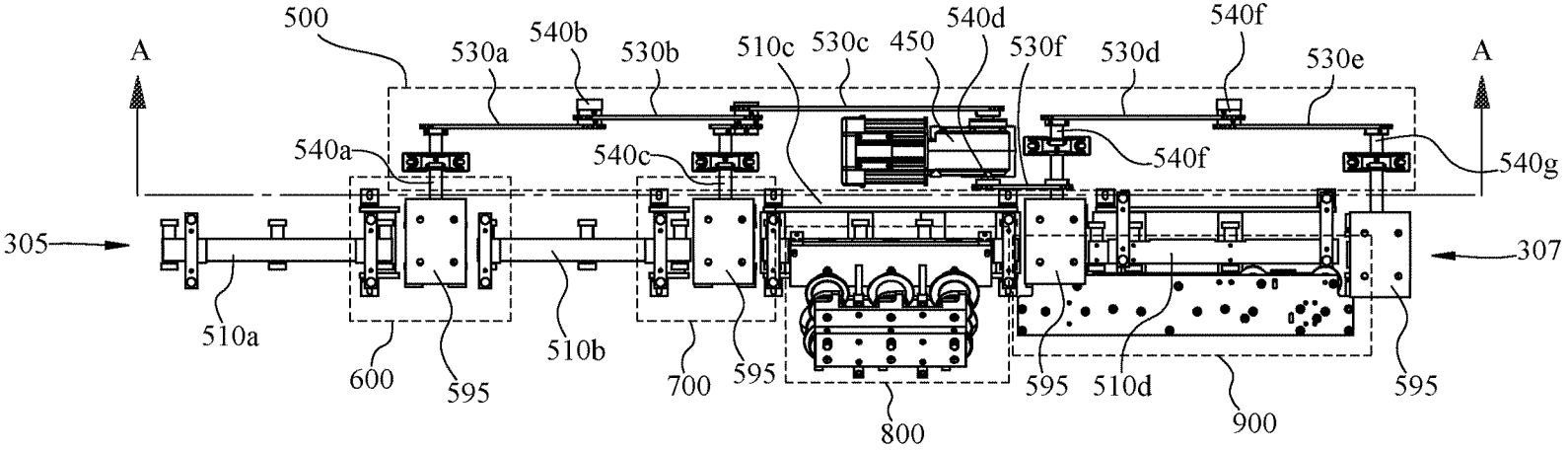
FIG. 4E shows a top plan view of a motor-driven conveyance system and a plurality of forming stages of a multi-speed lightweight gutter machine in accordance with one or more embodiments of the present invention.

Continuing, FIG. 4E shows a top plan view of a motor-driven conveyance system 500 and a plurality of forming stages 600, 700, 800, 900 of a multi-speed lightweight gutter machine (e.g., 200) in accordance with one or more embodiments of the present invention. Conveyance system 500 includes, starting from input end 305, drive shaft 540*a* that rotates lower rubber wheel 535*a*, drive shaft 540*b* that rotates an intermediate gear, drive shaft 540*c* that rotates lower rubber wheel 535*b*, drive shaft 540*d* of three-phase electric motor 450 that creates the rotation, drive shaft 540*e* that rotates lower rubber wheel 535*c*, drive shaft 540*f* that rotates an intermediate gear, and drive shaft 540*g* that rotates lower rubber wheel 535*d*. Three-phase electric motor 450 provides rotation by rotating drive shaft 540*d*. A plurality of drive chains 530*a*-530*g* transmit rotation to drive shafts

540*a*-540*g*. Drive chain 530*a* connects drive shafts 540*a* and 540*b*, drive chain 530*b* connects drive shafts 540*b* and 540*c*, drive chain 530*c* connects drive shafts 540*c* and 540*d*, drive chain 530*d* connects drive shafts 540*e* and 540*f*, drive chain 530*e* connects drive shafts 540*f* and 540*g*, drive chain 530*f* connects drive shafts 540*d* and 540*e*, and drive chain 530*g* connects drive shafts 540*c* and 540*h*. One of ordinary skill in the art will recognize that the conveyance system 500 is merely exemplary and may vary based on an application or design in accordance with one or more embodiments of the present invention.

Figure 4F:
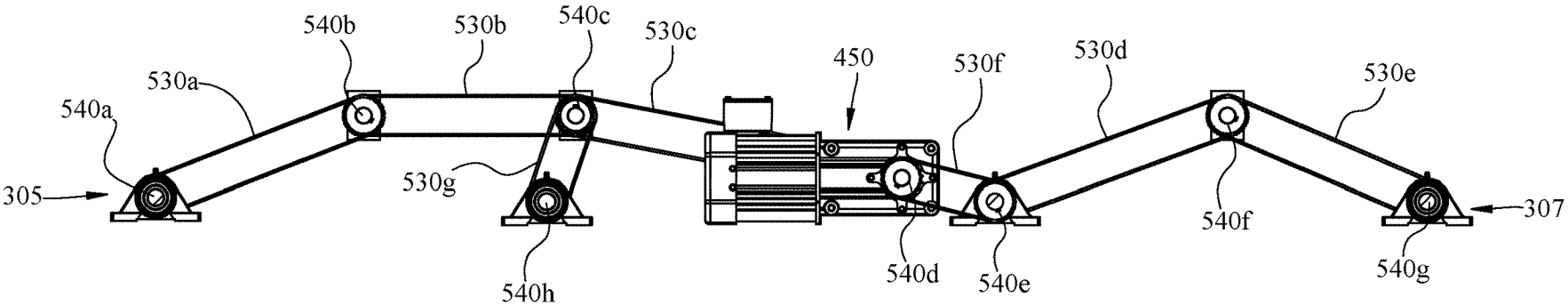
FIG. 4F shows a cross-sectional left side view of a motor-driven conveyance system of a multi-speed lightweight gutter machine in accordance with one or more embodiments of the present invention.

Continuing. FIG. 4F shows a cross-sectional left side view of a motor-driven conveyance system 500 of a multi-speed lightweight gutter machine (e.g., 200) in accordance with one or more embodiments of the present invention. In this view, an exemplary configuration of drive chains 530*a*-530*g* and drive shafts 540*a*-540*g* are shown. Drive shafts 540*a*, 540*h*, 540*e*, and 540*g* provide rotation to lower rubber wheels 535*a*, 535*b*, 535*c*, and 535*d* that move raw material (not shown) through the machine (e.g., 200). One of ordinary skill in the art will recognize that the number of drive shafts, drive chains, and their configuration may vary based on an application or design in accordance with one or more embodiments of the present invention.

Figure 5A:
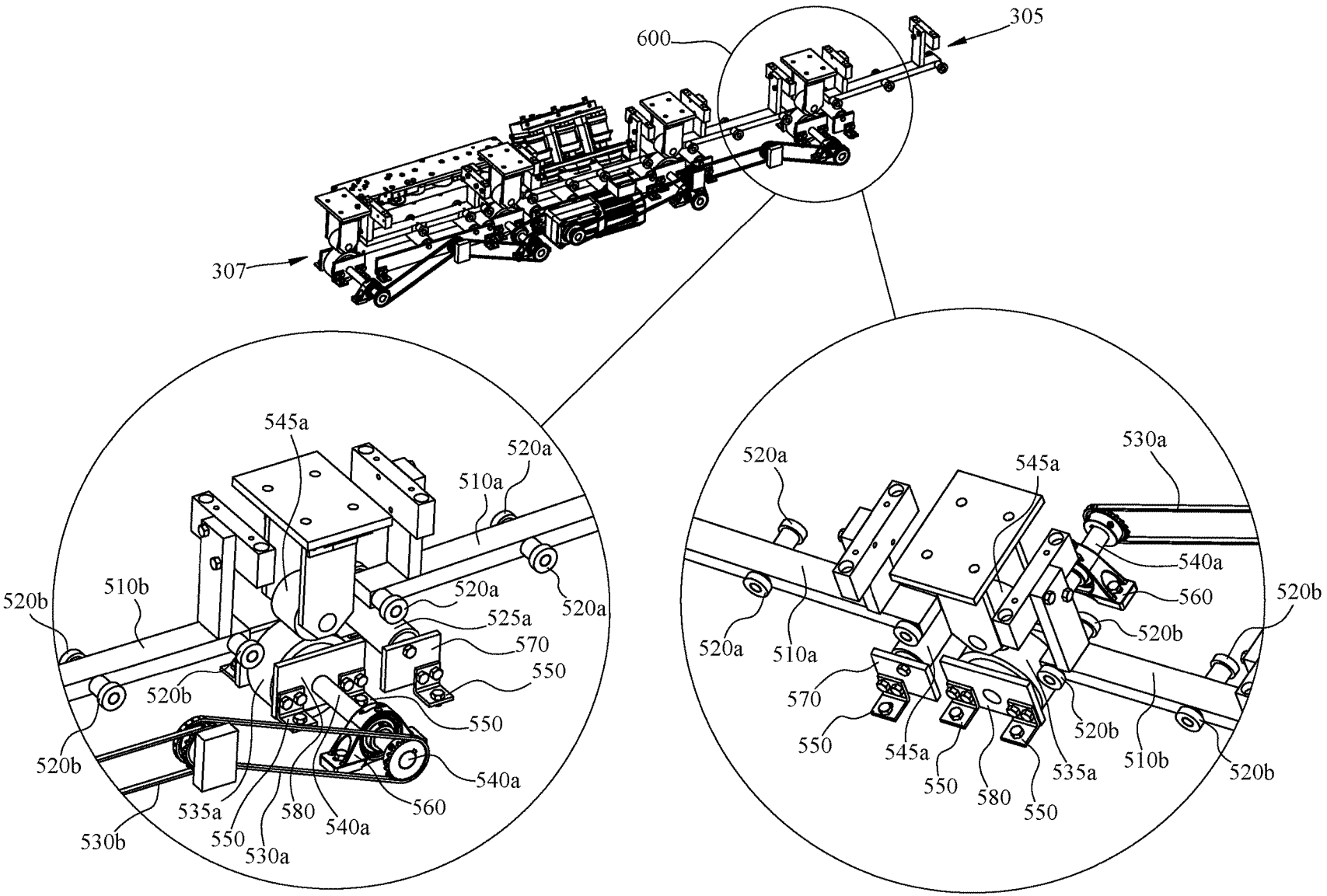
FIG. 5A shows a top-facing right side and a top-facing left side perspective view of a first forming stage of a multi-speed lightweight gutter machine in accordance with one or more embodiments of the present invention.

FIG. 5A shows a top-facing right side and a top-facing left side perspective view of a first forming stage 600 of a multi-speed lightweight gutter machine (e.g., 200) in accordance with one or more embodiments of the present invention. For this exemplary application, first forming stage 600 receives raw material (not shown) that is flat as it is fed under skate 510*a* and above lightweight flintstone transfer roller 525*a*. Drive shaft 540*a* rotates lower rubber wheel 535*a* and the raw material (not shown) forms an interference fit with lower rubber wheel 535*a* and upper rubber wheel 545*a*. Rotation of lower rubber wheel 535*a* advances the material through the stage. Skate 510*a* includes a plurality of skate rollers 520*a* disposed on both sides of skate 510*a*. Skate rollers 520*a* start to form a bottom shape to the raw material (not shown) as the sides are pushed upwards. Material (not shown) exiting first forming stage 600 has a slight U-shape.

Figure 5B:
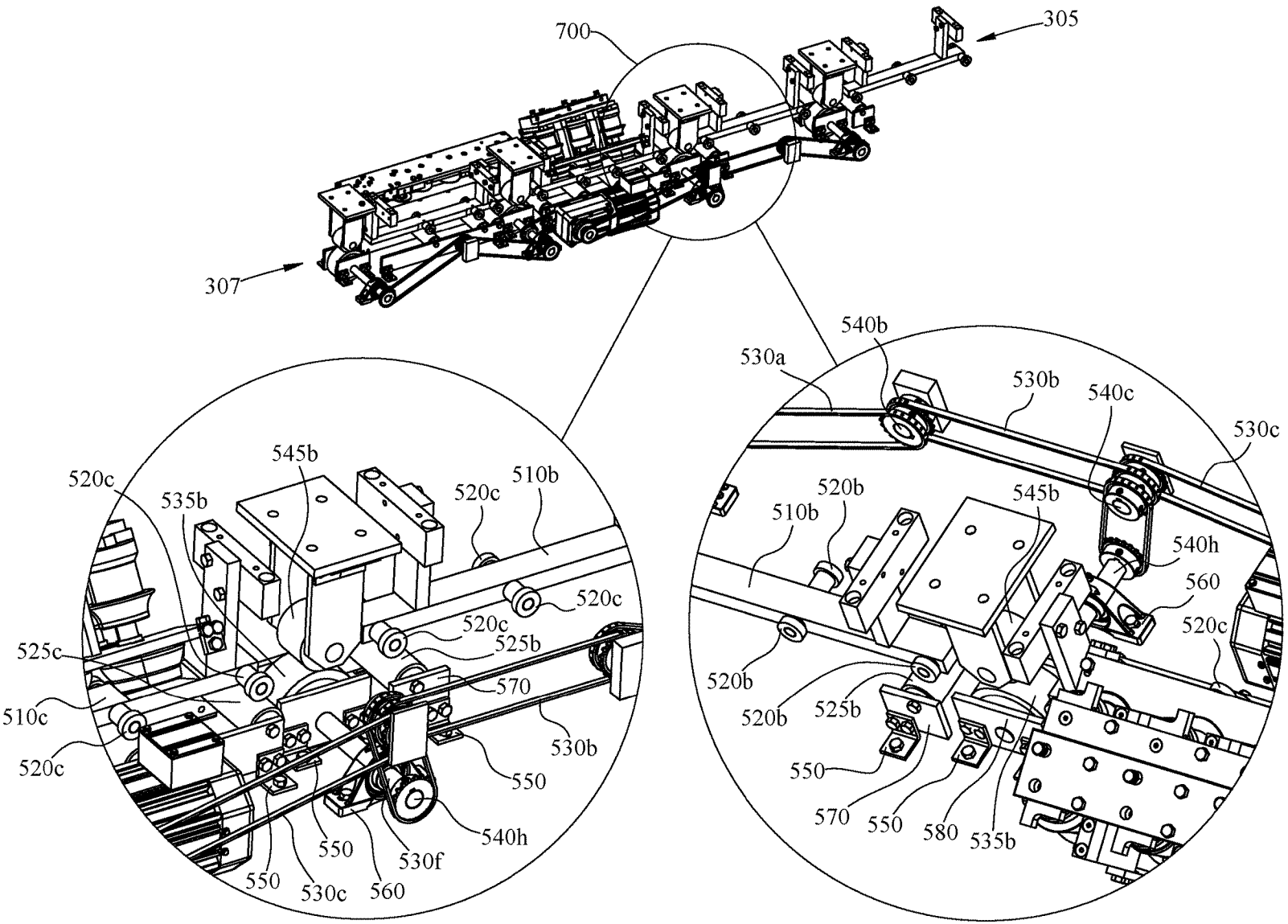
FIG. 5B shows a top-facing right side and a top-facing left side perspective view of a second forming stage of a multi-speed lightweight gutter machine in accordance with one or more embodiments of the present invention.

Continuing, FIG. 5B shows a top-facing right side and a top-facing eft side perspective view of a second forming stage 700 of a multi-speed lightweight gutter machine (e.g., 200) in accordance with one or more embodiments of the present invention. For this exemplary application, second forming stage 700 receives the slightly U-shaped material that continues under skate 510*b* and above lightweight flintstone transfer roller 525*b*. Drive shaft 540*h* rotates lower rubber wheel 535*b* and the material (not shown) forms an interference fit with lower rubber wheel 535*b* and upper rubber wheel 545*b*. Rotation of lower rubber wheel 535*b* advances the material through the stage. Skate rollers 520*b* continue to form the bottom shape of the material (not shown) as the sides are pushed further upwards. Material (not shown) exiting second forming stage 700 has a more pronounced U-shape.

Figure 5C:
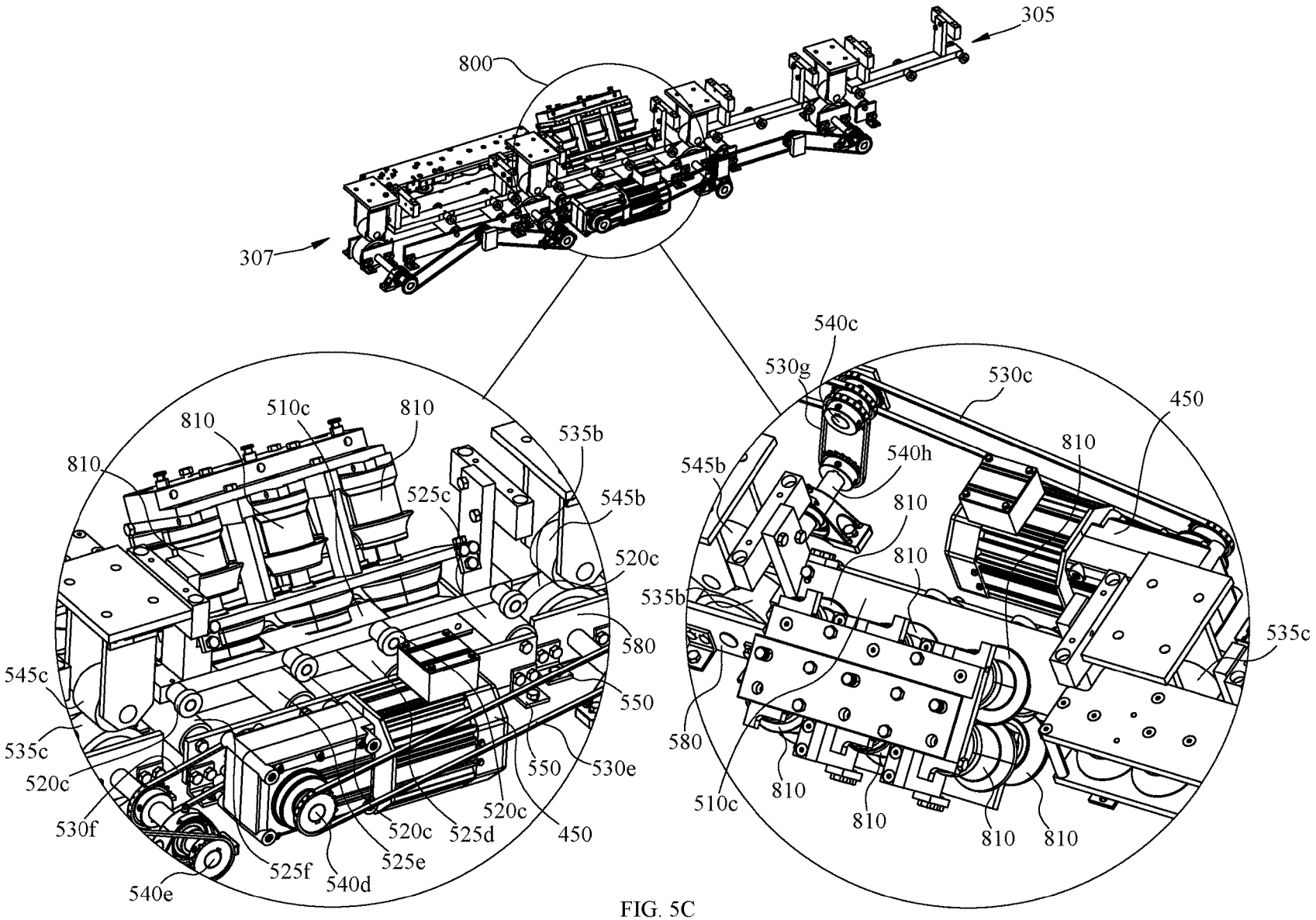
FIG. 5C shows a top-facing right side and a top-facing left side perspective view of a third forming stage of a multi-speed lightweight gutter machine in accordance with one or more embodiments of the present invention.

Continuing. FIG. 5C shows a top-facing right side and a top-facing left side perspective view of a third forming stage 800 of a multi-speed lightweight gutter machine (e.g., 200) in accordance with one or more embodiments of the present invention. For this exemplary application, third forming stage 800 receives the substantially U-shaped material (not shown) that continues under skate 510*c* and above lightweight flintstone transfer rollers 525*c*-525*f*. Drive shaft 540*e* rotates lower rubber wheel 535*c* and the material (not shown) forms an interference fit with lower rubber wheel 535*c* and upper rubber wheel 545*c*. One edge of the material advances through a plurality of lightweight forming wheels 810 arranged in what is known in the industry as a K-box configuration that forms an face on an outward facing side of a gutter profile to the material (not shown). As such, third forming stage 800 provides a nearly finished gutter profile to the material (not shown).

Figure 5D:
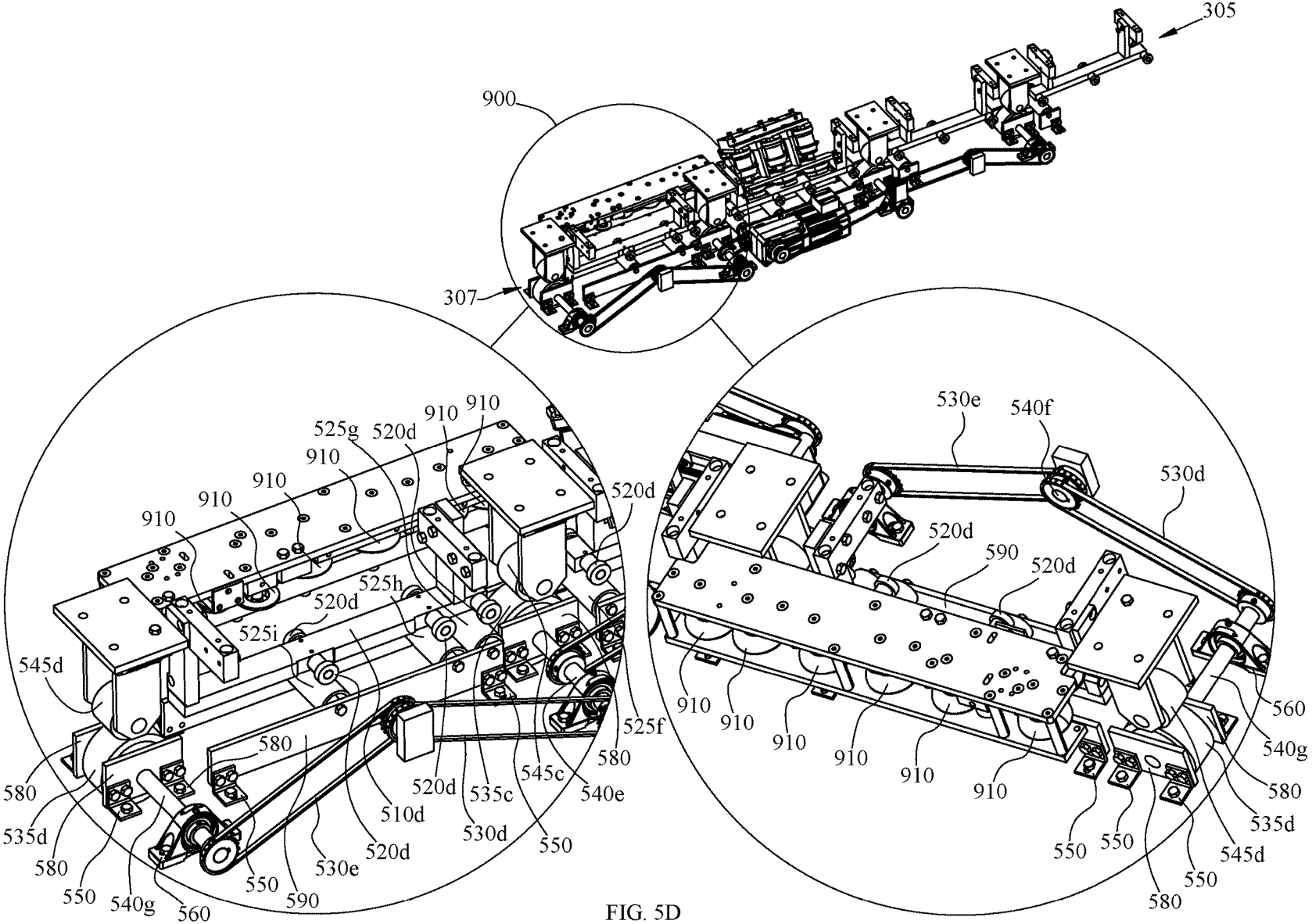
FIG. 5D shows a top-facing right side and a top-facing left side perspective view of a fourth forming stage of a multi-speed lightweight gutter machine in accordance with one or more embodiments of the present invention.

Continuing, FIG. 5D shows a top-facing right side and a top-facing left side perspective view of a fourth forming stage 900 of a multi-speed lightweight gutter machine (e.g., 200) in accordance with one or more embodiments of the present invention. For this exemplary application, fourth forming stage 900 receives the substantially shaped material (not shown) that continues under skate 510*d* and above lightweight flintstone transfer rollers 525*g*-525*i*. Drive shaft 540*g* rotates lower rubber wheel 535*d* and the material (not shown) forms an interference fit with lower rubber wheel 535*d* and upper rubber wheel 545*d*. The faced side of the material (not shown) advances through a plurality of lightweight forming wheels 910 arranged in what is known in the industry as a Lip-box configuration that forms a lip on a top-edge of the faced side of the material (not shown). As such, fourth forming stage 900 provides a finished cross-section gutter profile to the material (not shown).

Figure 6:
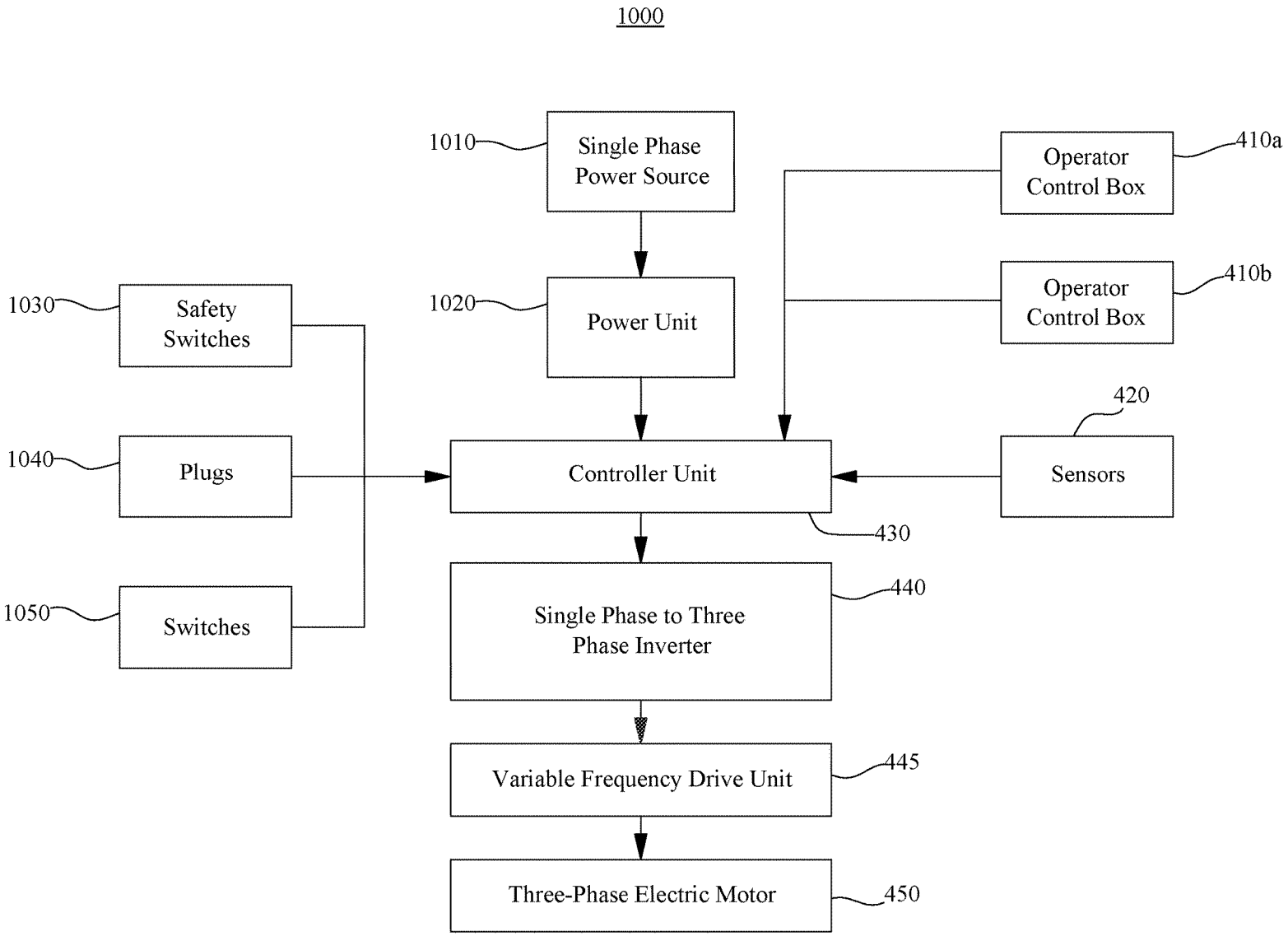
FIG. 6 shows a block diagram of a controller unit and other electrical devices of a multi-speed lightweight gutter machine in accordance with one or more embodiments of the present invention.

FIG. 6 shows a block diagram 1000 of a controller unit 430 and other electrical devices of a multi-speed lightweight gutter machine (e.g., 200) in accordance with one or more embodiments of the present invention. A single-phase fixed-frequency power source 1010 may be used to power the gutter machine (e.g., 200). This enables the use of a simple wall outlet, an automotive adapter, or generator that provides 110 v/120 v alternating current at 60 Hz. The single-phase power may be provided to power unit 1020. Power unit 1020 may include one or more circuit breakers/circuits that provide single-phase power to various components. For example, controller unit 430, single-phase to three-phase inverter unit 440, variable frequency drive unit 445, and others may require single-phase fixed-frequency power. Single-phase to three-phase inverter 440 may provide three-phase power to variable frequency drive unit 445. Variable frequency drive unit 445 may controllably provide three-phase power of a frequency corresponding to a user-specified speed, to three-phase electric motor 450. Controller 430 may command variable frequency drive unit 445 to a frequency that achieves the user-specified speed. While diagram 1000 is exemplary, one of ordinary skill in the art, having the benefit of this disclosure, would appreciate that the power distribution may vary based on an application or design in accordance with one or more embodiments of the present invention.

In one or more embodiments of the present invention, controller unit 430 may be a programmable logic controller ("PLC")-based system that the operator interacts with via touchscreen (e.g., 220) and operator control boxes 410*a*, 410*b*. The PLC (not independently illustrated) may be capable of being programmed to operate at a plurality of user-specified speeds. As previously discussed, variable frequency drive unit 445 may control a speed of three-phase electric motor 450 by controlling the frequency of the three-phase power applied to three-phase electric motor 450. The PLC may, for example, be programmed to provide options for a plurality of operating speeds, for example, a slow speed, a nominal/normal speed, and a fast speed. One of ordinary skill in the art will recognize that any number of speeds are possible, and the number of speed options present may vary based on an application or design. In addition, a switch or touchscreen input may determine whether the gutter machine 200 advances the material in a nominal/forward manner or backwards in a reverse manner. In addition, a start/job button and a stop button may be used by the PLC to start or stop the operation of gutter machine 200.

While controller unit 430 has been described as a PLC-based system, one of ordinary skill in the art, having the benefit of this disclosure, will appreciate that other types or kinds of computing systems may be used. For example, a general purpose computing system, an industrial computing system, a field programmable gate array ("FPGA")-based computing system, an application-specific integrated circuit ("ASIC")-based computing system, and combinations thereof may be used in accordance with one or more embodiments of the present invention. Further, one of ordinary skill in the art, having the benefit of this disclosure, will recognize that any such system may be reduced to only those components necessary to perform the desired function or scaled up as needed to meet requirements. As such, any of the above-noted components, or various subsets, supersets, or combinations of functions or features thereof, may be integrated, in whole or in part, or distributed among various devices based on an application, design, or form factor in accordance with one or more embodiments of the present invention. As such, the description of controller unit 430 is merely exemplary and not intended to limit the type, kind, or configuration of components that constitute a controller unit 430 suitable for controlling gutter machine 200.

Figure 7A:
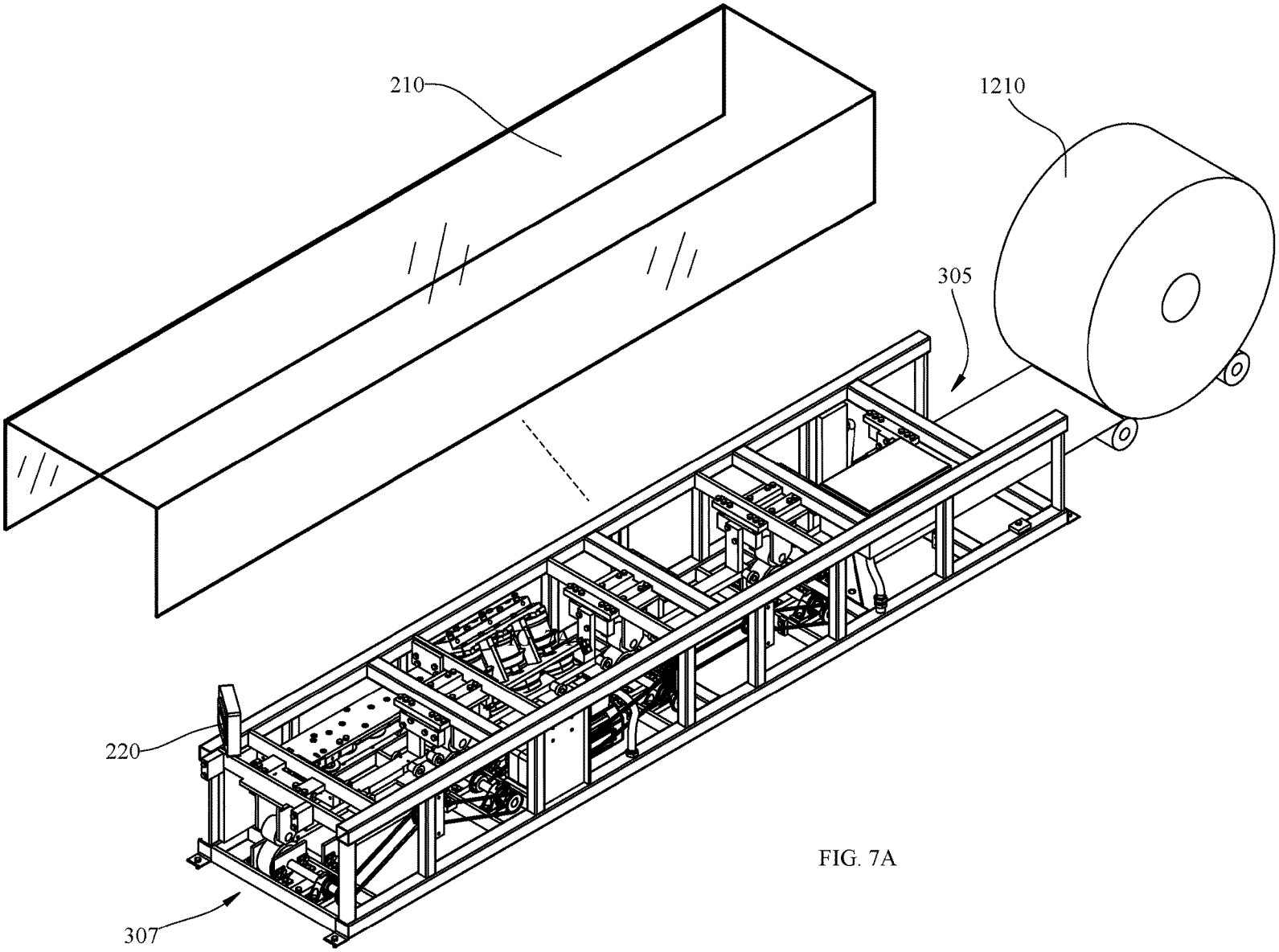
FIG. 7A shows a top-facing right side perspective view of a multi-speed lightweight gutter machine with a transparent protective cover in accordance with one or more embodiments of the present invention.
Figure 7B:
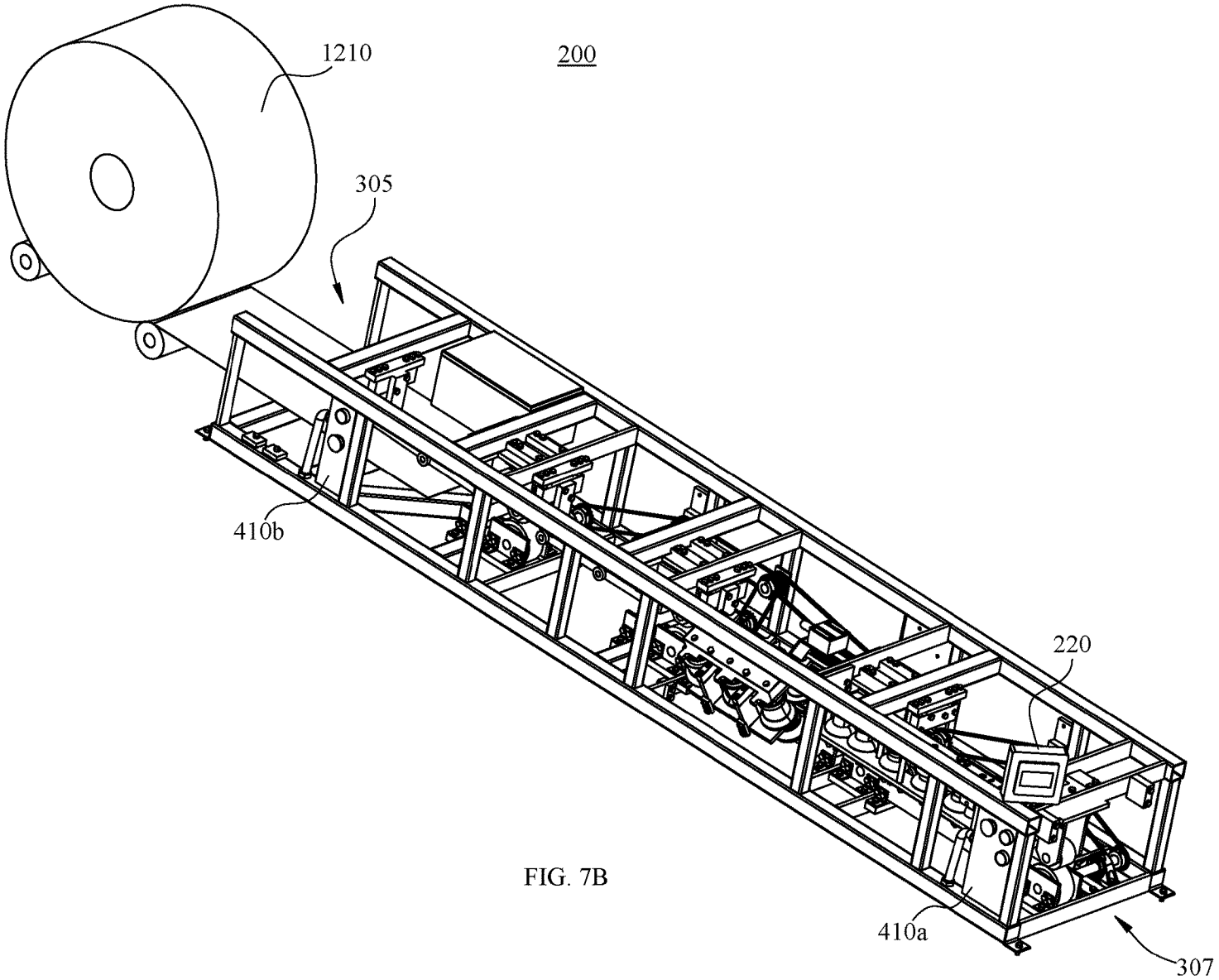
FIG. 7B shows a top-facing left side perspective view of a multi-speed lightweight gutter machine with coiled roll of sheet metal in accordance with one or more embodiments of the present invention.

FIG. 7A shows a top-facing right side perspective view of a multi-speed lightweight gutter machine 200 with a transparent protective cover 210 in accordance with one or more embodiments of the present invention. A transparent protective cover 210 may form a protective cover over at least three sides of gutter machine 200, with input end 305 and output end 307 at least partially exposed so that raw material may be fed into input end 305 and formed gutter may exit output end 307. In certain embodiments, transparent protective cover 210 may be composed of plexiglass. In other embodiments, transparent protective cover 210 may be composed of polyvinyl chloride. In still other embodiments, transparent protective cover may be composed of polycarbonate. In still other embodiments, transparent protective cover 210 may be composed of acrylic. One of ordinary skill in the art, having the benefit of this disclosure, will appreciate that transparent protective cover 210 may be composed of other transparent material in accordance with one or more embodiments of the present invention. Continuing, FIG. 7B shows a top-facing left side perspective view of a multi-speed lightweight gutter machine 200 with coiled roll of raw material 1210 in accordance with one or more embodiments of the present invention. In this view, operator control boxes 410*a* and 410*b* are more clearly shown as well as touch-screen display 220. The operator may use operator control box 410*b* at the input end when loading a new coiled roll of raw material. The operator may use operator control box 410*a* at the output end when operating the machine to produce gutters. Each control box 410*a*. 410*b* may include a start/jog button, a stop button, and a forward/reverse switch (not independently illustrated).

Figure 7C:
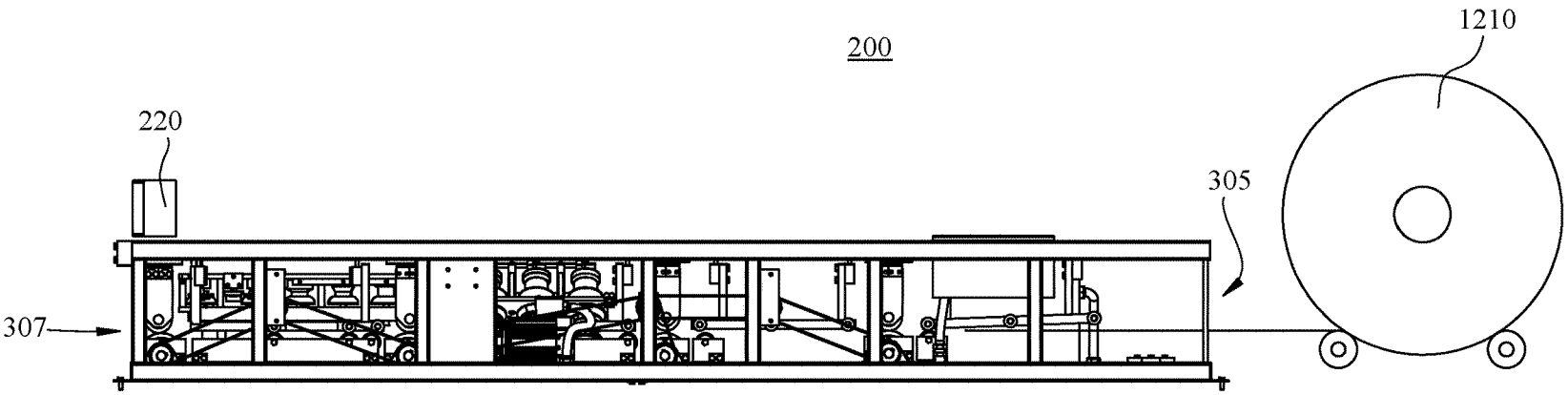
FIG. 7C shows a right side elevation view of a multi-speed lightweight gutter machine with coiled roll of sheet metal in accordance with one or more embodiments of the present invention.
Figure 7D:
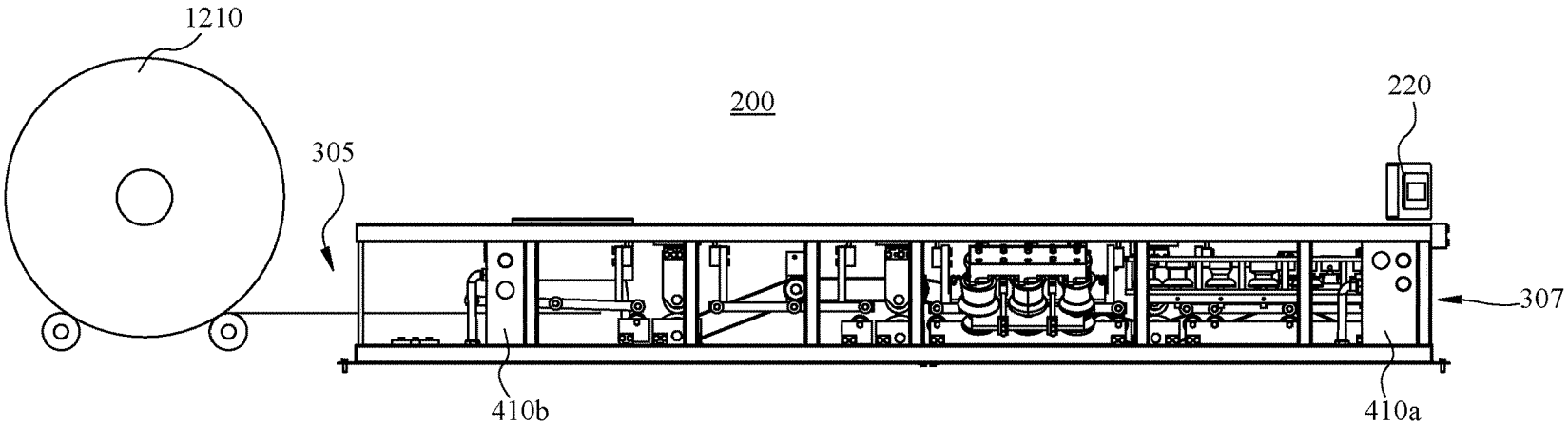
FIG. 7D shows a left side elevation view of a multi-speed lightweight gutter machine with coiled roll of sheet metal in accordance with one or more embodiments of the present invention.
Figure 7E:
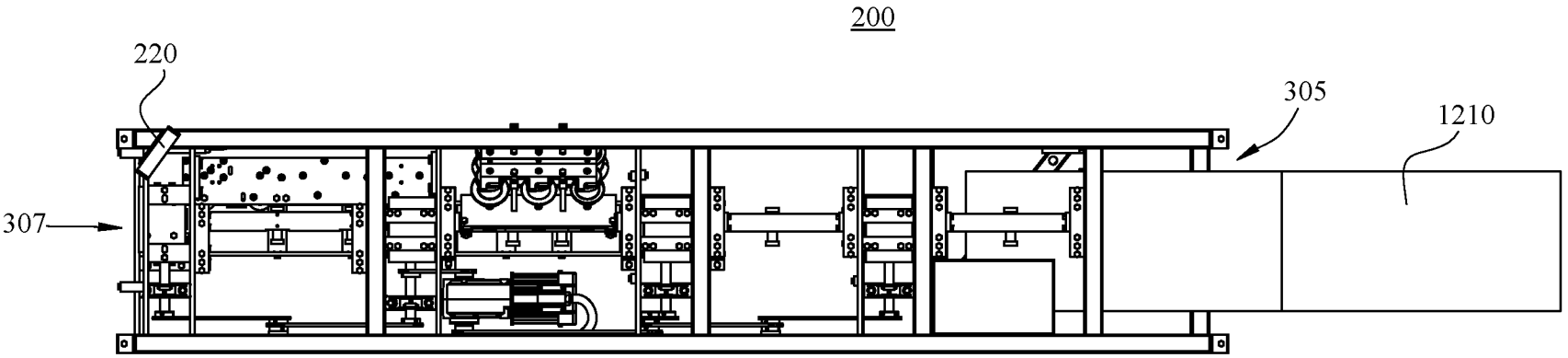
FIG. 7E shows a top plan view of a multi-speed lightweight gutter machine with coiled roll of sheet metal in accordance with one or more embodiments of the present invention.
Figure 7F:
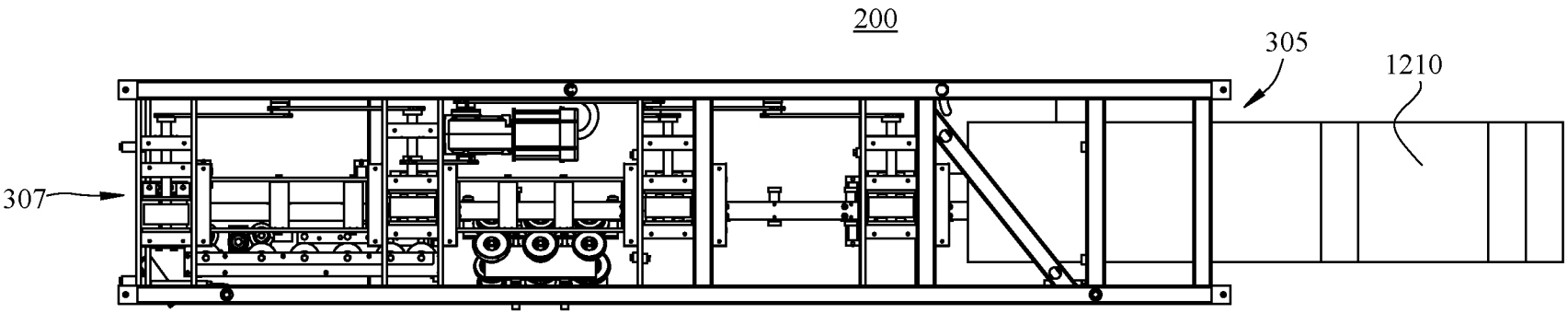
FIG. 7F shows a bottom plan view of a multi-speed lightweight gutter machine with coiled roll of sheet metal in accordance with one or more embodiments of the present invention.
Figure 7G:
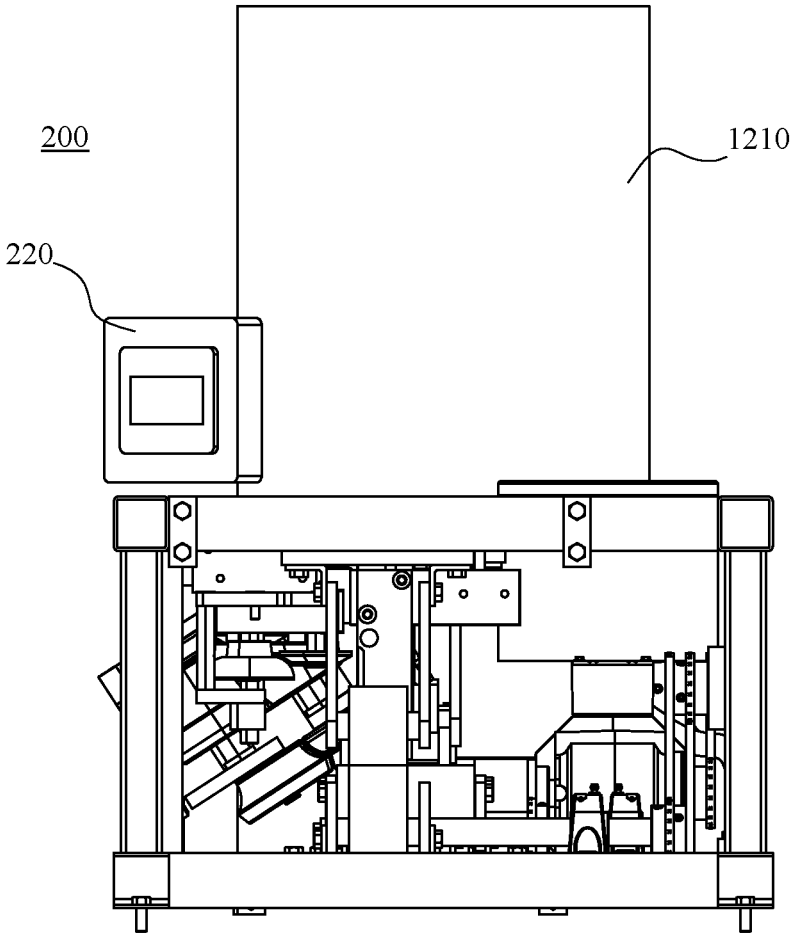
FIG. 7G shows a front elevation view of a multi-speed lightweight gutter machine with coiled roll of sheet metal in accordance with one or more embodiments of the present invention.
Figure 7H:
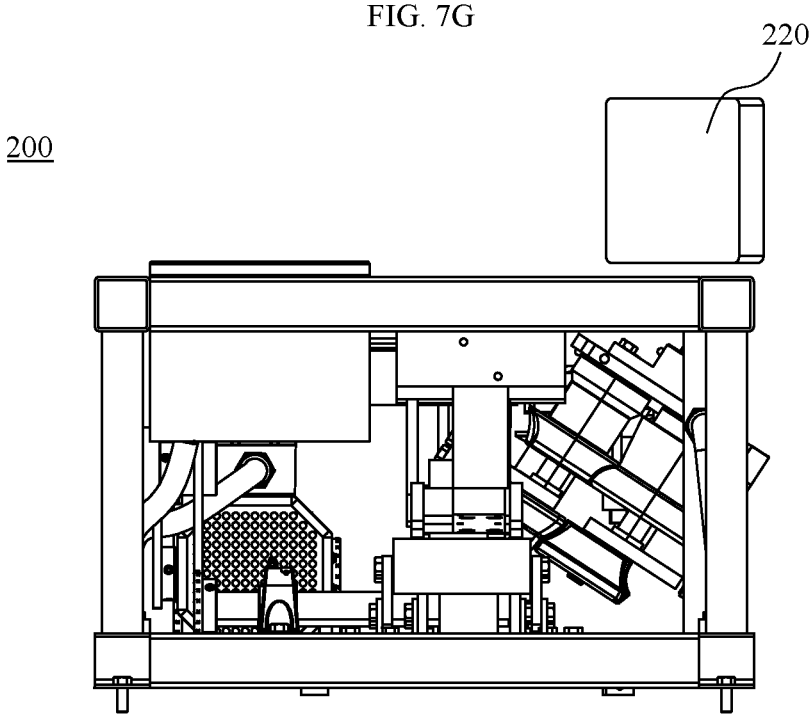
FIG. 7H shows a rear elevation view of a multi-speed lightweight gutter machine with coiled roll of sheet metal in accordance with one or more embodiments of the present invention.

Continuing, FIG. 7C shows a right side elevation view of a multi-speed lightweight gutter machine 200 with coiled roll of raw material 1210 in accordance with one or more embodiments of the present invention. Continuing. FIG. 7D shows a left side elevation view of a multi-speed lightweight gutter machine 200 with coiled roll of raw material 1210 in accordance with one or more embodiments of the present invention. Continuing, FIG. 7E shows a top plan view of a multi-speed lightweight gutter machine 200 with coiled roll of raw material 1210 in accordance with one or more embodiments of the present invention. Continuing. FIG. 7F shows a bottom plan view of a multi-speed lightweight gutter machine 200 with coiled roll of raw material 1210 in accordance with one or more embodiments of the present invention. Continuing, FIG. 7G shows a front elevation view of a multi-speed lightweight gutter machine 200 with coiled roll of raw material 1210 in accordance with one or more embodiments of the present invention. Continuing, FIG. 7H shows a rear elevation view of a multi-speed lightweight gutter machine 200 with coiled roll of raw material 1210 in accordance with one or more embodiments of the present invention.

Figure 8A:
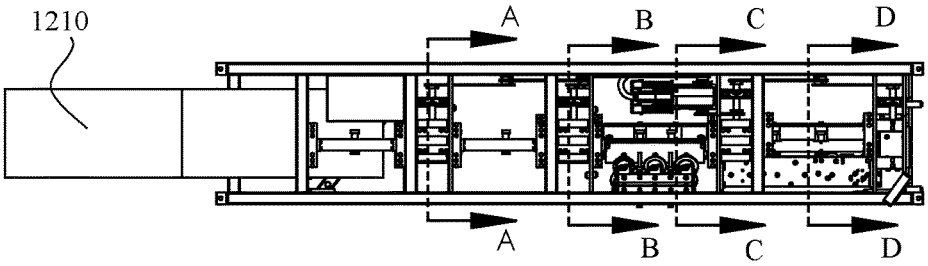
FIG. 8A shows a cross-sectional view of a first forming stage of a multi-speed lightweight gutter machine in accordance with one or more embodiments of the present invention.
Figure 8A:
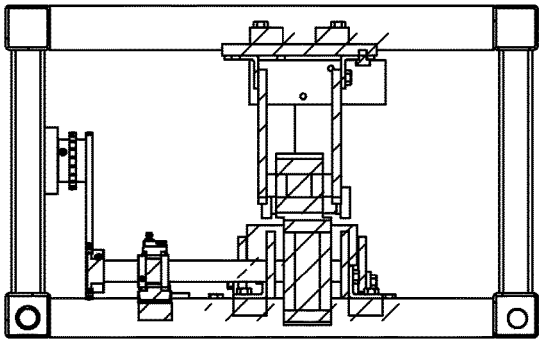
Figure 8C:
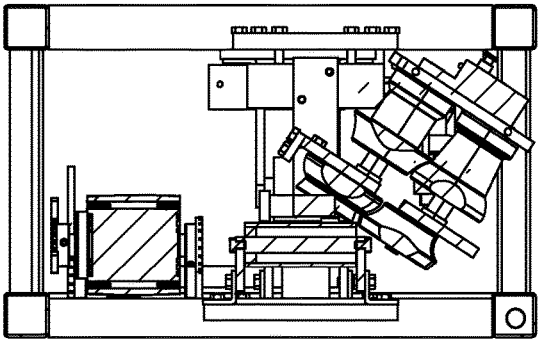
FIG. 8C shows a cross-sectional view of a third forming stage of a multi-speed lightweight gutter machine in accordance with one or more embodiments of the present invention.
Figure 8B:
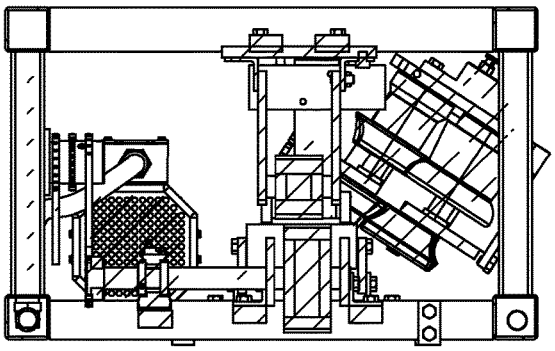
FIG. 8B shows a cross-sectional view of a second forming stage of a multi-speed lightweight gutter machine in accordance with one or more embodiments of the present invention.
Figure 8D:
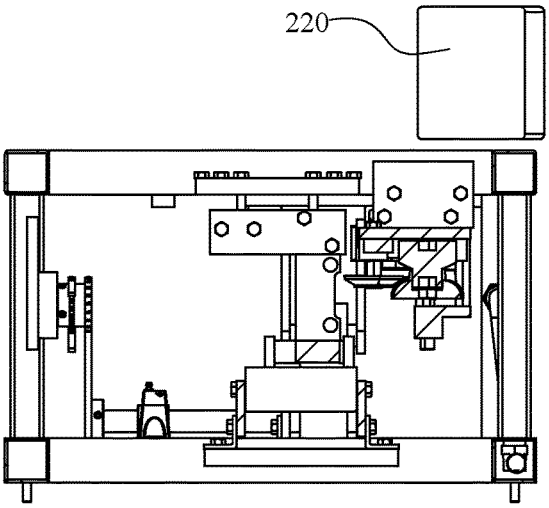
FIG. 8D shows a cross-sectional view of a fourth forming stage of a multi-speed lightweight gutter machine in accordance with one or more embodiments of the present invention.

FIG. 8A shows a cross-sectional view of first forming stage 600 of a multi-speed lightweight gutter machine 200 in accordance with one or more embodiments of the present invention. Continuing. FIG. 8B shows a cross-sectional view of a second forming stage 700 of a multi-speed lightweight gutter machine 200 in accordance with one or more embodiments of the present invention. Continuing, FIG. 8C shows a cross-sectional view of a third forming stage 800 of a multi-speed lightweight gutter machine 200 in accordance with one or more embodiments of the present invention. Continuing, FIG. 8D shows a cross-sectional view of a fourth forming stage 900 of a multi-speed lightweight gutter machine 200 in accordance with one or more embodiments of the present invention.

Figure 9:
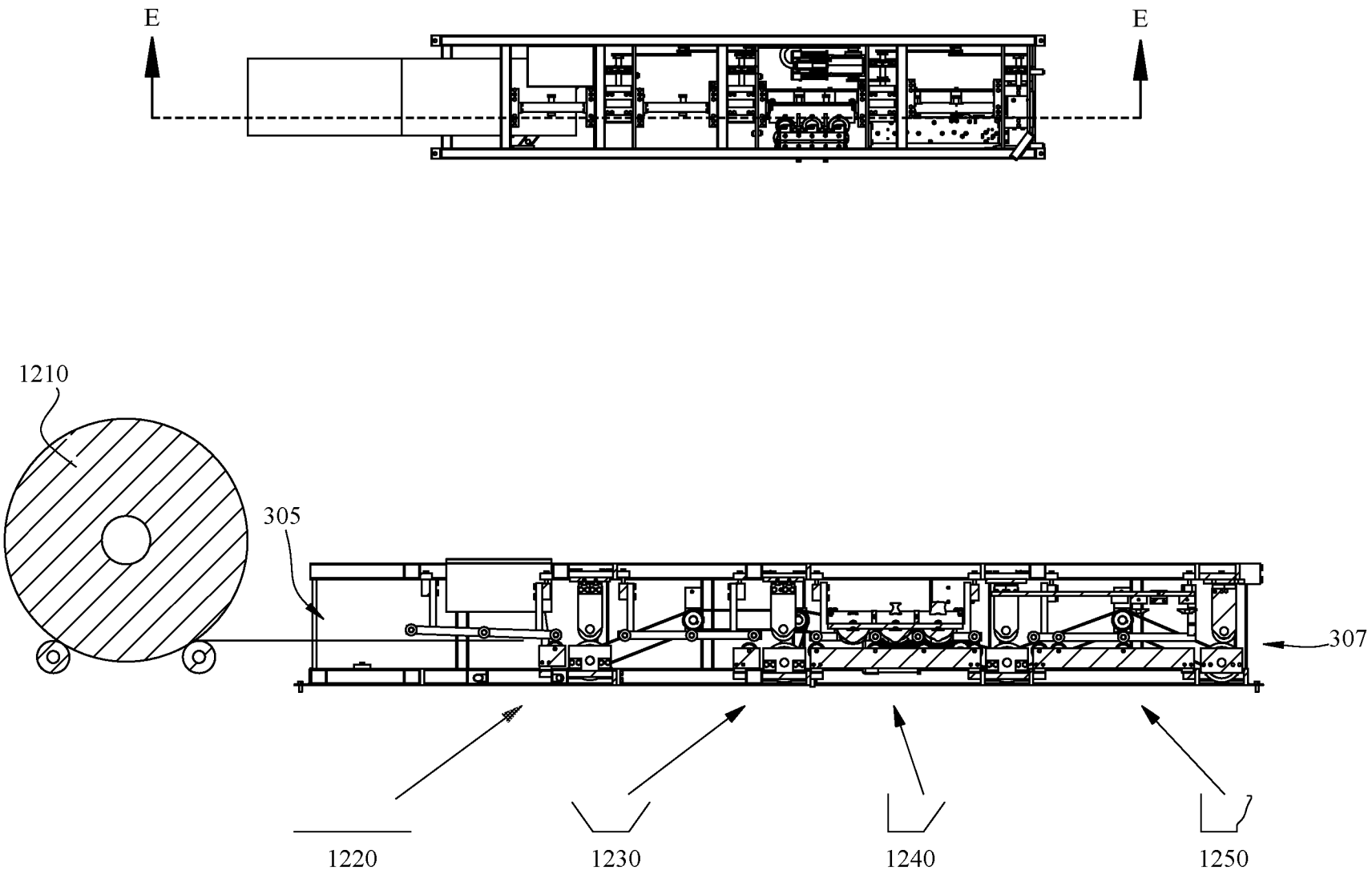
FIG. 9 shows an example of progressively forming a cross-sectional gutter profile with a multi-speed lightweight gutter machine in accordance with one or more embodiments of the present invention.

FIG. 9 shows an example of progressively forming a cross-sectional gutter profile with a multi-speed lightweight gutter machine 200 in accordance with one or more embodiments of the present invention. As previously discussed, first forming stage (e.g., 600) forms a slightly U-shape to the advancing material, second forming stage (e.g., 700) produces a more pronounced U-shape to the advancing material, third forming stage (e.g., 800) produces a face on an outward facing side of the advancing material, and fourth forming stage (e.g., 900) products a lip on the face of the outward facing side of the advancing material, producing a desired cross-sectional gutter profile.

Figure 10:
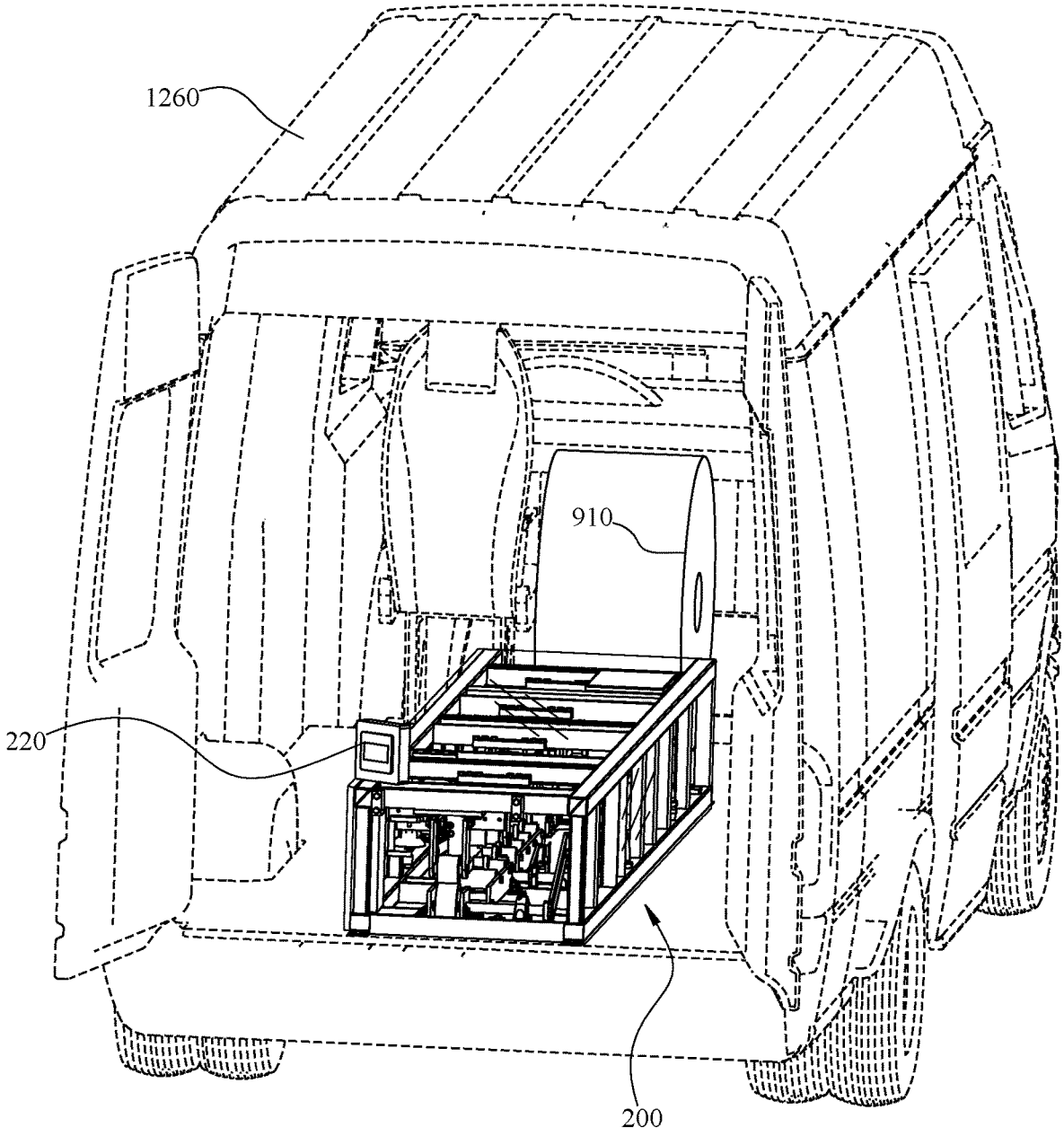
FIG. 10 shows a multi-speed lightweight gutter machine in a work truck showing an environment of use on a job site in accordance with one or more embodiments of the present invention.

FIG. 10 shows a multi-speed lightweight gutter machine 200 in a work truck 1260 showing an environment of use on a job site in accordance with one or more embodiments of the present invention. As previously discussed, multi-speed lightweight gutter machine 200 may be disposed in the back of a work truck or on a tow-behind trailer so that it may be easily transported from job site to job site. Typically, the output end (e.g., 307) of gutter machine 200 is facing the cargo doors of the work truck such that the operator may stand near gutter machine 200 and produce a desired length of seamless gutter.

In one or more embodiments of the present invention, a multi-speed lightweight gutter machine may include an aluminum frame having one or more hollow structural members, where one or more of the hollow structural members have one or more wiring access ports that provide access to the hollow interior of the frame. The machine may further includes a transparent protective cover for the aluminum frame, a power unit that receives single-phase power, an inverter unit that converts single-phase power to three-phase power, a three-phase electric motor, a variable frequency drive unit that controls a speed of the electric motor by controlling a frequency of the three-phase power applied to the electric motor, a controller unit that controls the variable frequency drive unit, and a conveyance system driven by the electric motor that controllably moves material through a plurality of forming stages to be progressively formed into a seamless gutter. The plurality of forming stages may include a plurality of lightweight structural support members, a plurality of lightweight flintstone transfer rollers, and at least some of the plurality of forming stages may include a plurality of lightweight forming wheels that are composed of lightweight plastic. One or more of the power unit, the inverter unit, the three-phase electric motor, the variable frequency drive unit, and the controller unit are connected by wiring at least partially routed in the hollow interior of the frame.

In certain embodiments, the lightweight plastic may be Electra Plastic®. The lightweight structural support members, lightweight flintstone transfer rollers, and the lightweight forming wheels may be formed by injection molding with Electra Plastic®. In other embodiments, the lightweight plastic may be another plastic, polymer, or composition thereof, having a tensile hardness of at least 27,000 psi. In certain embodiments, the aluminum frame may include one or more longitudinal rails, one or more vertical support columns, one or more transverse crossbars, one or more Y-crossbars, and one or more weldment mounts. In certain embodiments, the aluminum frame may have a substantially rectangular shape. The power unit, the inverter unit, the three-phase electric motor, the variable frequency drive unit, the controller unit, and the conveyance system may be at least partially disposed within an interior area of the aluminum frame. In certain embodiments, the aluminum frame may be composed of aluminum. In other embodiments, the aluminum frame may be composed of other metals or alloys that weigh substantially less than structural steel material. To ensure the reduction in weight, the material used should weigh approximately one-third as much, or less, than the weight of structural steel conventionally used for framing.

In certain embodiments, the power unit may include a 110 v/120 v single-phase power input, a plurality of circuit breakers in line with the power input, a first branch of 110 v/120 v single-phase power routed to the controller unit, and a second branch of 110 v/120 v single-phase power routed to the inverter unit. In certain embodiments, the inverter unit may include a 110 v/120 v single-phase power input and a 220 v/230 v three-phase power output. In certain embodiments, the three-phase electric motor may include an electric motor having a power rating in a range between 1 and 2 horsepower. In certain embodiments, the three-phase electric motor may include three poles or one pair of poles per phase. In certain embodiments, the variable frequency drive unit may control the frequency of the three-phase power provided to the electric motor in a range between 60 and hertz ("Hz"). Notwithstanding, the variable frequency drive unit may be capable of a frequency between 0 Hz and 400 Hz. In certain embodiments, the controller unit may provide a user with an option of operating the multi-speed lightweight gutter machine and a plurality of predetermined operating speeds. In certain embodiments, a touchscreen may be used as the human-computer interface for the controller unit.

In certain embodiments, a first operator control box may be disposed near an input end of the multi-speed lightweight gutter machine, and a second operator control box may be disposed near an output end of the multi-speed lightweight gutter machine. In certain embodiments, a latching mechanism may be used to controllably secure the transparent protective cover to the aluminum frame, and a sensor may be used that provides a sensor signal to the controller unit that indicates whether the transparent protective cover is properly secured in place or not. The controller unit may stop the multi-speed lightweight gutter machine if the sensor signal indicates that the transparent protective cover is not properly secured in place.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should only be limited by the appended claims.

The invention claimed is:

1. A multi-speed lightweight gutter machine comprising:

an aluminum frame comprising one or more hollow structural members, wherein one or more of the hollow structural members comprise one or more wiring access ports that provide access to the hollow interior of the frame;

a transparent protective cover for the aluminum frame;

a power unit that receives single-phase power;

an inverter unit that converts single-phase power to three-phase power;

a three-phase electric motor;

a variable frequency drive unit that controls a speed of the electric motor by controlling a frequency of the three-phase power to the electric motor;

a controller unit that controls the variable frequency drive unit; and a conveyance system driven by the electric motor that controllably moves material to be progressively formed through a plurality of forming stages, wherein each of the plurality of forming stages comprise a plurality of lightweight structural support members and at least some of the plurality of forming stages comprise a plurality of lightweight forming wheels composed of lightweight plastic, and wherein one or more of the power unit, the inverter unit, the three-phase electric motor, the variable frequency drive unit, and the controller unit are connected by wiring at least partially routed in the hollow interior of the frame.

2. The multi-speed lightweight gutter machine of claim 1, wherein the lightweight plastic is Electra Plastic®.

3. The multi-speed lightweight gutter machine of claim 1, wherein the plurality of forming wheels is formed by injection molding with Electra Plastic®.

4. The multi-speed lightweight gutter machine of claim 1, wherein the lightweight plastic is composed of a lightweight plastic, polymer, or alloy having a tensile hardness of at least 27,000 psi.

5. The multi-speed lightweight gutter machine of claim 1, wherein the aluminum frame comprises one or more longitudinal rails, one or more vertical support columns, one or more transverse crossbars, one or more Y-crossbars, and one or more weldment mounts.

6. The multi-speed lightweight gutter machine of claim 1, wherein the aluminum frame has a substantially rectangular shape wherein the power unit, the inverter unit, the three-phase electric motor, the variable frequency drive unit, the controller unit, and the conveyance system are at least partially disposed within an interior area of the aluminum frame.

7. The multi-speed lightweight gutter machine of claim 1, wherein the aluminum frame is composed of aluminum, other metals, or alloys thereof, weighing substantially less than structural steel.

8. The multi-speed lightweight gutter machine of claim 1, wherein the power unit comprises a 110 v/120 v single-phase power input, a plurality of circuit breakers in line with the power input, a first branch of 110 v/120 v single-phase power routed to the controller unit, and a second branch of 110 v/120 v single-phase power routed to the inverter unit.

9. The multi-speed lightweight gutter machine of claim 1, wherein the inverter unit comprises a 110 v/120 v single-phase power input and a 220 v/230 v three-phase power output.

10. The multi-speed lightweight gutter machine of claim 1, wherein the three-phase electric motor comprises a motor having a power rating in a range between 1 and 2 horsepower.

11. The multi-speed lightweight gutter machine of claim 1, wherein the three-phase electric motor comprises three poles or one pair of poles per phase.

12. The multi-speed lightweight gutter machine of claim 1, wherein the variable frequency drive unit controls the frequency of the three-phase power provided to the electric motor in a range between 60 and 75 Hz.

13. The multi-speed lightweight gutter machine of claim 1, wherein the controller unit provides an option of operating the multi-speed lightweight gutter machine and a plurality of predetermined operating speeds.

14. The multi-speed lightweight gutter machine of claim 1, further comprising:

a touchscreen interface for the controller unit.

15. The multi-speed lightweight gutter machine of claim 1, further comprising:

a first operator control box disposed near an input end of the multi-speed lightweight gutter machine, and a second operator control box disposed near an output end of the multi-speed lightweight gutter machine.

16. The multi-speed lightweight gutter machine of claim 1, further comprising:

a latching mechanism to controllably secure the transparent protective cover to the aluminum frame; and a sensor that provides a sensor signal to the controller unit that indicates whether the transparent protective cover is properly secured in place or not, wherein the controller unit stops the multi-speed lightweight gutter machine if the sensor signal indicates that the transparent protective cover is not properly secured in place.

* * * * *